US009403382B2

(12) United States Patent
Osanai et al.

(10) Patent No.: US 9,403,382 B2
(45) **Date of Patent: *Aug. 2, 2016**

(54) PRINTING APPARATUS, PRINTING SYSTEM, AND PRINTED MATERIAL MANUFACTURING METHOD

(71) Applicants: Toshitaka Osanai, Kanagawa (JP); Masakazu Yoshida, Kanagawa (JP); Junji Nakai, Kanagawa (JP); Hiroyoshi Matsumoto, Kanagawa (JP)

(72) Inventors: Toshitaka Osanai, Kanagawa (JP); Masakazu Yoshida, Kanagawa (JP); Junji Nakai, Kanagawa (JP); Hiroyoshi Matsumoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/482,597

(22) Filed: Sep. 10, 2014

(65) Prior Publication Data

US 2015/0077458 A1 Mar. 19, 2015

(30) Foreign Application Priority Data

Sep. 13, 2013 (JP) ..... 2013190736
Sep. 4, 2014 (JP) ..... 2014180271

(51) Int. Cl.
*B41J 11/02* (2006.01)
*B41J 11/00* (2006.01)

(52) U.S. Cl.
CPC ..... *B41J 11/0015* (2013.01)

(58) Field of Classification Search
USPC ..... 347/101, 102, 104
See application file for complete search history.

(56) References Cited

U.S. PATENT DOCUMENTS 5,291,225 A * 3/1994 Saito ..... B41J 11/48 250/559.4
6,528,129 B1 * 3/2003 Kondo ..... H05H 1/24 427/535
7,169,444 B2 * 1/2007 Onishi ..... B41J 11/0015 347/105
7,338,580 B2 * 3/2008 Conta ..... B41J 2/1404 204/224 M
7,654,662 B2 * 2/2010 Nakazawa ..... B41J 2/2114 106/31.37
8,186,823 B2 * 5/2012 Saitoh ..... B41J 11/0015 347/102
8,201,925 B2 * 6/2012 Saito ..... B41J 2/1404 347/40
8,287,115 B2 * 10/2012 Shinkawa ..... B41J 11/002 347/102
8,746,869 B2 * 6/2014 Matsuyama ..... C09D 11/322 347/100

(Continued)

FOREIGN PATENT DOCUMENTS

JP 2000-301711 10/2000
JP 2001-288569 10/2001
JP 2010-058404 3/2010

*Primary Examiner* — Matthew Luu
*Assistant Examiner* — Lily Kemathe
(74) *Attorney, Agent, or Firm* — Duft Bornsen & Fettig LLP

(57) ABSTRACT

A printing apparatus includes an acidification treatment unit that acidifies at least a surface of a treatment object by irradiating the treatment object with plasma; an inkjet recording unit that records to the treatment object having been acidified by the acidification pretreatment unit in an inkjet recording system; and a control unit that specifies an ink to be used by the inkjet recording unit from at least two types of inks having different properties, based on the type of the treatment object and an amount of plasma energy used in a plasma treatment performed by the acidification treatment unit or based on a pH value of the surface of the treatment object.

9 Claims, 15 Drawing Sheets

(56) References Cited

U.S. PATENT DOCUMENTS 8,778,200 B2 * 7/2014 Kubota ..... B41J 2/1603 216/2
8,967,784 B2 * 3/2015 Ram ..... B41J 11/0015 347/101
9,010,918 B2 * 4/2015 Gotou ..... B41J 11/0015 347/100
9,050,802 B2 * 6/2015 Uno ..... B41J 2/14233
2005/0024458 A1 * 2/2005 Sanada ..... C09D 11/32 347/100
2005/0206704 A1 * 9/2005 Ikeda ..... B41M 5/52 347/100
2005/0243121 A1 * 11/2005 Onishi ..... B41J 2/2114 347/21
2009/0095708 A1 * 4/2009 Kubota ..... B41J 2/1603 216/27
2009/0290007 A1 * 11/2009 Saitoh ..... C09D 11/322 347/102
2010/0201753 A1 * 8/2010 Saito ..... B41J 2/1404 347/65
2013/0050363 A1 * 2/2013 Usui ..... B41J 2/175 347/93
2013/0250017 A1 * 9/2013 Saitoh ..... C08J 7/00 347/101
2015/0035918 A1 * 2/2015 Matsumoto ..... B41M 5/0011 347/101
2015/0077492 A1 * 3/2015 Nemoto ..... B41M 5/0011 347/102
2015/0077493 A1 * 3/2015 Saitoh ..... B41J 11/0015 347/102
2015/0138287 A1 * 5/2015 Saitoh ..... B41J 11/0015 347/101

* cited by examiner

PRINTING APPARATUS, PRINTING SYSTEM, AND PRINTED MATERIAL MANUFACTURING METHOD

CROSS-REFERENCE TO RELATED APPLICATIONS

The present application claims priority to and incorporates by reference the entire contents of Japanese Patent Application No. 2013-190736 filed in Japan on Sep. 13, 2013 and Japanese Patent Application No. 2014-180271 filed in Japan on Sep. 4, 2014.

BACKGROUND OF THE INVENTION

1. Field of the Invention

The present invention relates to a printing apparatus, printing system, and a printed material manufacturing method.

2. Description of the Related Art

With respect to high-speed printing, it is difficult to increase a printing speed in a shuttle system which is a mainstream of a current inkjet recording system, and therefore a single-pass system using a page-width line head has been proposed. However, although the single pass system is advantageous to the printing speed, a time interval between dropped adjacent dots is short, and an adjacent dot is dropped before previously dropped ink penetrates into a printing medium. Therefore, coalescence of the adjacent dots (called "droplet interference") occurs, which results in occurrence of beading, bleeding, or the like, and this may cause image quality to degrade.

There is also a problem that when an inkjet printing apparatus prints an image on non-permeable media or on slow-permeable media, such as a film or a coated paper, adjacent ink dots move to coalesce, which causes an image defect such as beading or bleeding.

Conventionally, therefore, a printing speed is reduced and a drying device is installed in order to overcome the weakness of a plain paper and a coated paper. In addition, there is a method of previously applying a primer liquid to the printing medium in order to improve a setting property of aqueous ink.

As other method of improving the setting property of the aqueous ink, a method of performing a plasma treatment on the surface of a printing medium is proposed. It is known that the plasma treatment is performed to hydrophilize the surface of the printing medium. Therefore, the performance of the plasma treatment can improve a hydrophilic property and a permeability of a coated paper with poor wettability. Furthermore, the plasma treatment is a drying process, and therefore it is advantageous that the drying process is not necessary.

Therefore, there is a need to provide a printing apparatus, a printing system, and a printed material manufacturing method capable of appropriately using inks having different properties such as pH reaction.

SUMMARY OF THE INVENTION

It is an object of the present invention to at least partially solve the problems in the conventional technology.

According to an embodiment, there is provided a printing apparatus that includes an acidification treatment unit that acidifies at least a surface of a treatment object by irradiating the treatment object with plasma; an inkjet recording unit that records to the treatment object having been acidified by the acidification pretreatment unit in an inkjet recording system; and a control unit that specifies an ink to be used by the inkjet recording unit from at least two types of inks having different properties, based on the type of the treatment object and an amount of plasma energy used in a plasma treatment performed by the acidification treatment unit or based on a pH value of the surface of the treatment object.

According to another embodiment, there is provided a printing system that includes an acidification treatment device that acidifies at least a surface of a treatment object by irradiating the treatment object with plasma; and an inkjet recording device that records to the treatment object having been acidified by the acidification pretreatment device in an inkjet recording system. The inkjet recording device includes a control unit that specifies an ink to be used by the inkjet recording device from at least two types of inks having different properties, based on the type of the treatment object and an amount of plasma energy used in a plasma treatment performed by the acidification treatment unit or based on a pH value of the surface of the treatment object.

According to still another embodiment, there is provided a printed material manufacturing method for manufacturing a printed material obtained by forming an image on a treatment object in an inkjet recording system. The method include acidifying at least a surface of the treatment object by irradiating the treatment object with plasma; specifying an ink to be used in the forming of the image from at least two types of inks having different properties, based on the type of the treatment object and an amount of plasma energy used in a plasma treatment performed at the acidifying or based on a pH value of the surface of the treatment object; and recording to the treatment object having been acidified by the acidification pretreatment unit with the ink specified.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention will be explained in detail below with reference to the accompanying drawings. The embodiments explained below are the exemplary embodiments of the present invention, and therefore various technically favorable limitations are applied thereto. However, the scope of the present invention is not unreasonably limited by the following explanation, or all the components explained in the following embodiments are not necessarily essential to the present invention.

In the following embodiment, a pretreatment for acidifying the surface of a treatment object is performed in order to aggregate pigments while preventing dispersion of ink pigments immediately after the ink is landed on the treatment object (recording medium, printing medium, printing media, or simply called "media").

The acidification in the present explanation means that the pH value of the surface of the printing medium is decreased to a pH value at which the pigments contained in the ink are aggregated. To decrease the pH value is to increase the concentration of hydrogen ion $H^+$ in an object. The pigments in the ink before coming into contact with the surface of the treatment object are negatively charged, and are therefore dispersed in a vehicle.

Figure 1:
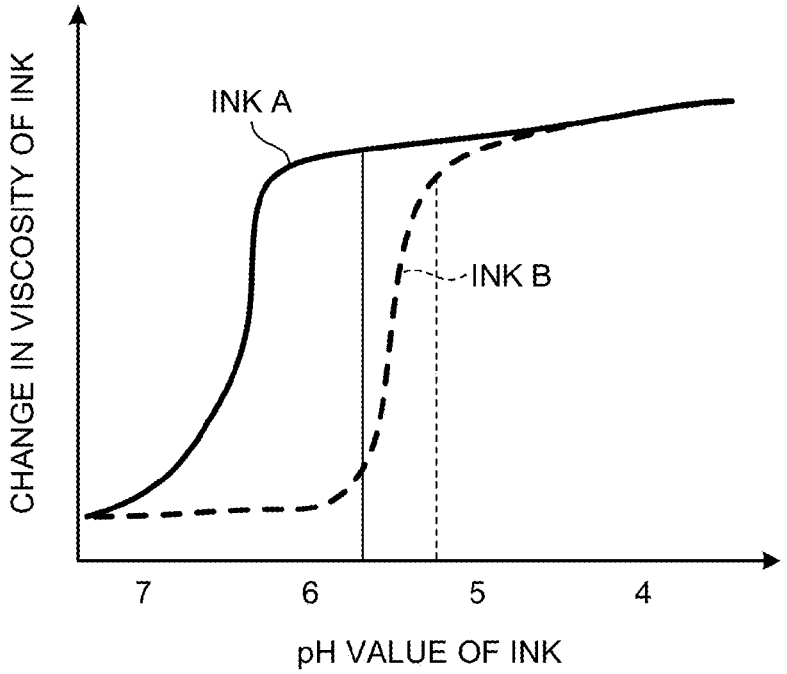
FIG. 1 is a diagram of an example of a relationship between a pH value of ink and a viscosity of ink according to an embodiment of the present invention.

FIG. 1 depicts an example of a relationship between the pH value of the ink and the viscosity of the ink. As illustrated in FIG. 1, the viscosity of the ink increases as the pH value decreases. This is because the negatively charged pigments in the vehicle of the ink are further electrically neutralized with an increase in the acidity of the ink and therefore the pigments are aggregated. Thus, in the graph illustrated in FIG. 1, for example, by decreasing the pH value of the surface of the printing medium so that the pH value of the ink reaches a value corresponding to the necessary viscosity, it is possible to increase the viscosity of the ink. This is because when the ink adheres to the acid surface of the printing medium, the pigments are electrically neutralized with the hydrogen ion $H^+$ on the surface of the printing medium and the pigments are thereby aggregated. This enables to prevent color mixture between adjacent dots and to prevent the pigments from penetrating into the deep inside of the printing medium (even into its back side). To decrease the pH value of the ink so as to reach the pH value corresponding to the necessary viscosity, it is required to make the pH value of the surface of the printing medium lower than the pH value of the ink corresponding to the necessary viscosity.

The pH value to obtain the necessary viscosity for the ink differs depending on the properties of the ink. In other words, as illustrated in an ink A in FIG. 1, some inks are those in which pigments are aggregated at a pH value comparatively close to the neutral and the viscosity is thereby increased, and some other inks are those in which a pH value lower than that of the ink A is necessary in order to aggregate the pigments as illustrated in an ink B having a property different from that of the ink A.

Therefore, in the present embodiment, wettability of a surface of the treatment object, or aggregability or permeability of the ink pigments due to decrease in the pH value is controlled by an acidification treatment, and the inks are selectively used according to changes in pH of the surface of the treatment object due to the acidification treatment. It is thereby possible to prevent color mixture between adjacent ink dots (hereinafter, "dots") and to prevent the pigments from penetrating into deep inside of the treatment object (even into the back side). It is also possible to improve the circularity of a dot and to prevent coalescence of dots so as to enhance sharpness of the dots and increase a color gamut. Consequently, an image defect such as beading or bleeding is improved, and a printed material on which a high quality image is formed can be obtained. By making thin and uniform the thickness of aggregation of the pigments on the treatment object, it is also possible to reduce an amount of ink droplet and achieve reduction in drying energy of the ink and reduction in printing costs.

In the following embodiment, a plasma treatment for irradiating the surface of the treatment object with plasma will be exemplified as a pretreatment for acidifying the surface of the treatment object. However, the embodiment is not limited thereto. For example, it is possible to arbitrarily substitute some other acidification treatment such as a primer treatment for applying a treatment liquid called an acid primer liquid to the surface of the treatment object, or to combine the primer treatment and the plasma treatment.

Atmospheric-pressure non-equilibrium plasma treatment for performing plasma irradiation in the atmosphere can be used as a plasma treatment which is an acidification treatment. In the atmospheric-pressure non-equilibrium plasma treatment, the plasma irradiation in the atmosphere is performed on the treatment object to cause polymer on the surface of the treatment object to react, and hydrophilic functional group is formed.

More specifically, electrons emitted from a discharge electrode are accelerated in an electric field to excite and ionize atoms and particles in the atmosphere. Electrons are also emitted from the ionized atoms and particles, high-energy electrons are increased, and streamer discharge (plasma) is thereby generated. The high-energy electrons generated by the streamer discharge break polymer bounds on the surface of a treatment object (e.g., coated paper) (a coated layer of the coated paper is solidified with calcium carbonate and starch as a binder, and the starch has a polymer structure), and are re-combined with oxygen radical O*, hydroxyl radical (—OH), or ozone $O_3$ in gas phase. These treatments are called plasma treatment. Thereby, polar functional groups such as hydroxyl groups or carboxyl groups are formed on the surface of the treatment object 20. Accordingly, hydrophilicity or acidity is given to the surface of the treatment object 20. By increasing the carboxyl groups, the surface of the treatment object 20 is acidified (the pH value is lowered).

To prevent occurrence of color mixture between dots on the treatment object, caused by wet spreading and coalescence of the dots due to an increase in the hydrophilicity, it is found to be important to aggregate colorants (e.g., pigments or dyes) in a dot, to dry the vehicles before wet spreading of the vehicles, or to cause the vehicles to penetrate into the treatment object. Therefore, in the following embodiment, to aggregate the colorants or to cause the vehicles to penetrate into the treatment object, an acidification treatment for acidifying the surface of the treatment object is executed as a pretreatment of the inkjet recording processing.

Figure 2:
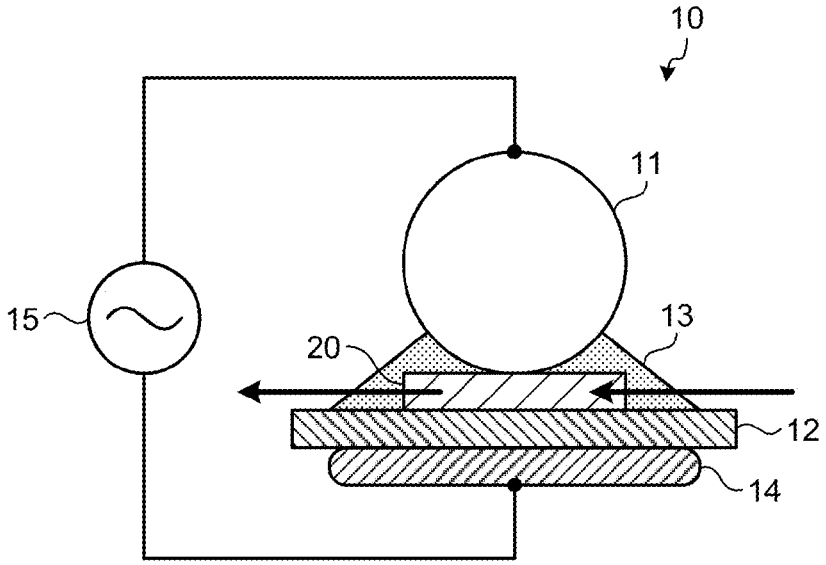
FIG. 2 is a schematic diagram of an example of a plasma treatment device according to the embodiment.

The atmospheric-pressure non-equilibrium plasma treatment is one of preferable methods because an electron temperature is extremely high and a gas temperature is around normal temperature. To stably generate atmospheric-pressure non-equilibrium plasma over a wide range, it is most preferable to use dielectric barrier discharge based on streamer dielectric breakdown obtained by applying alternate high-voltage between electrodes coated with a dielectric body. FIG. 2 depicts an example of an atmospheric-pressure non-equilibrium plasma treatment device using dielectric barrier discharge.

As illustrated in FIG. 2, an atmospheric-pressure non-equilibrium plasma treatment device 10 includes a discharge electrode 11, a counter electrode 14, a dielectric body (belt) 12 disposed between these electrodes, and a high-frequency high-voltage power supply 15. The discharge electrode 11 and the counter electrode 14 may be an electrode of which metal portion is exposed, or may be an electrode which is coated with a dielectric body or an insulating body such as insulating rubber or ceramics. The dielectric body 12 disposed between the discharge electrode 11 and the counter electrode 14 may be an insulating body such as polyimide, silicone, or ceramics. When corona discharge is used as the plasma treatment, the dielectric body 12 may be omitted. However, for example, when the dielectric barrier discharge is used, it may be preferable that the dielectric body 12 is disposed. In this case, for the position of the dielectric body 12, an area of creeping discharge is more widened in a case where the dielectric body 12 is disposed near or in contact with the counter electrode 14 than in a case where it is disposed near or in contact with the discharge electrode 11. Therefore, it is possible to further enhance the effect of the plasma treatment. The discharge electrode 11 and the counter electrode 14 (or an electrode in the side where the dielectric body 12 is disposed is the relevant dielectric body 12) may be arranged at a position in contact with the treatment object 20 passing through between the two electrodes, or may be arranged at a position not in contact therewith.

The high-frequency high-voltage power supply 15 applies a high-frequency and high-voltage pulse voltage between the discharge electrode 11 and the counter electrode 14. A voltage value of the high-frequency and high-voltage pulse is, for example, about 10 kV (p-p). The frequency can be, for example, about 20 kHz. By supplying the high-frequency and high-voltage pulse between the two electrodes, atmospheric-pressure non-equilibrium plasma 13 is generated between the discharge electrode 11 and the dielectric body 12. The treatment object 20 passes through between the discharge electrode 11 and the dielectric body 12 during generation of the atmospheric-pressure non-equilibrium plasma 13. Thereby the surface of the treatment object 20 on the discharge electrode 11 side is subjected to plasma treatment.

The atmospheric-pressure non-equilibrium plasma treatment device 10 illustrated in FIG. 2 adopts the discharge electrode 11 of a rotary type and the dielectric body 12 of a belt conveyor type. The treatment object 20 held and conveyed between the discharge electrode 11 and the dielectric body 12 passes through the atmospheric-pressure non-equilibrium plasma 13. Therefore, the surface of the treatment object 20 comes in contact with the atmospheric-pressure non-equilibrium plasma 13, and the plasma treatment is uniformly performed on the treatment object 20. However, the plasma treatment device adopted in the embodiment is not limited to the configuration of FIG. 2. For example, the configuration can be variously deformed into those such as a configuration in which the discharge electrode 11 is disposed not in contact with but near the treatment object 20 or a configuration in which the discharge electrode 11 is mounted on a carriage on which an inkjet head is mounted. In addition, a flat-plate dielectric body 12 can also be adopted instead of a belt-conveyor type dielectric body 12.

As a method of generating the atmospheric-pressure non-equilibrium plasma, various methods can be used in addition to the dielectric barrier discharge based on streamer dielectric breakdown. For example, dielectric barrier discharge for inserting an insulating body such as a dielectric body into between electrodes, corona discharge for forming a non-uniform electric field in a thin metal wire or the like, and pulse discharge for applying a short pulse voltage can be adopted. Moreover, a combination of two or more of these methods is also possible.

To prevent color mixture between dots due to wet spreading and coalescence of adjacent dots on the treatment object, it is found to be important to uniform colorants (e.g., pigments or dyes) in a dot, to dry the vehicles before wet spreading of the vehicles, or to cause the vehicles to penetrate into the treatment object.

The acidification treatment for acidifying the surface of the treatment object is one of effective means to dry the vehicles before wet spreading of the vehicles or to cause the vehicles to penetrate into the treatment object. The acidification treatment for acidifying the surface of the treatment object is particularly effective for a treatment object with low permeability such as a coated paper or a polymer film. However, when the plasma treatment is used as the acidification treatment, a high amount of energy is necessary for plasma irradiation in the atmosphere in order to obtain a sufficient effect for the treatment object with low permeability.

A behavior such that colorants are aggregated in a dot, a dry speed of the vehicles, and a penetration speed thereof into the treatment object differ depending on the size of a droplet (mj) varying depending on the size (a small droplet, a medium droplet, and a large droplet) of dots, the type of a treatment object, and the type of ink. Therefore, in the following embodiment, for example, a level of the pretreatment such as an energy of the plasma treatment (hereinafter, "amount of plasma energy") and a coating amount of a primer liquid is set to an appropriate value according to the type of a treatment object and a print mode (droplet amount etc.), and ink to be used is changed according to the pH value of the surface of the treatment object after the pretreatment. Therefore, in the following embodiment, by changing treatment control according to the type of the treatment object, the level of the pretreatment (for example, the amount of plasma energy) is optimized, and by measuring the wettability of the treatment object after the pretreatment or the pH value of the surface and switching the ink to be used, optimal inkjet recording for all the treatment objects can be achieved. At this time, by reducing an operating load of the plasma treatment or the coating amount of the primer liquid, energy saving can be achieved and a life of the device can be prolonged.

The printing apparatus, the printing system, and the printed material manufacturing method according to the embodiment of the present invention will be explained in detail below with reference to the accompanying drawings. The present embodiment will explain an image forming device including discharge heads (recording heads, ink heads) for four colors of black (K), cyan (C), magenta (M), and yellow (Y); however, the embodiment is not limited to the discharge heads. In other words, the image forming device may further include discharge heads corresponding to green (G), red (R), and some other colors, or may include a discharge head for only black (K). In the following explanation, K, C, M, and Y correspond to black, cyan, magenta, and yellow, respectively.

In the present embodiment, a continuous roll sheet (hereinafter, "roll sheet") is used as the treatment object; however, the embodiment is not limited thereto. For example, any medium, such as a cut sheet, capable of forming an image may be employed. Therefore, an overhead projector (OHP) sheet, a synthetic resin film, a metallic thin film, or others capable of forming an image on their surfaces with ink or the like can be used as the treatment object. When the treatment object is a non-permeable sheet or a slow permeable sheet as coated paper, the present embodiment can be more effective than the other cases. A continuous sheet used as a roll sheet may have a line of perforations, along which the roll sheet can be cut off, formed at a predetermined interval. In this case, a page in the roll sheet is an area between lines of perforations formed at a predetermined interval. When a sheet such as a roll sheet or a cut sheet is used as the treatment object, a type used for the sheet includes plain paper, high-quality paper, recycled paper, thin paper, cardboard, coated paper, and the like.

Figure 3:
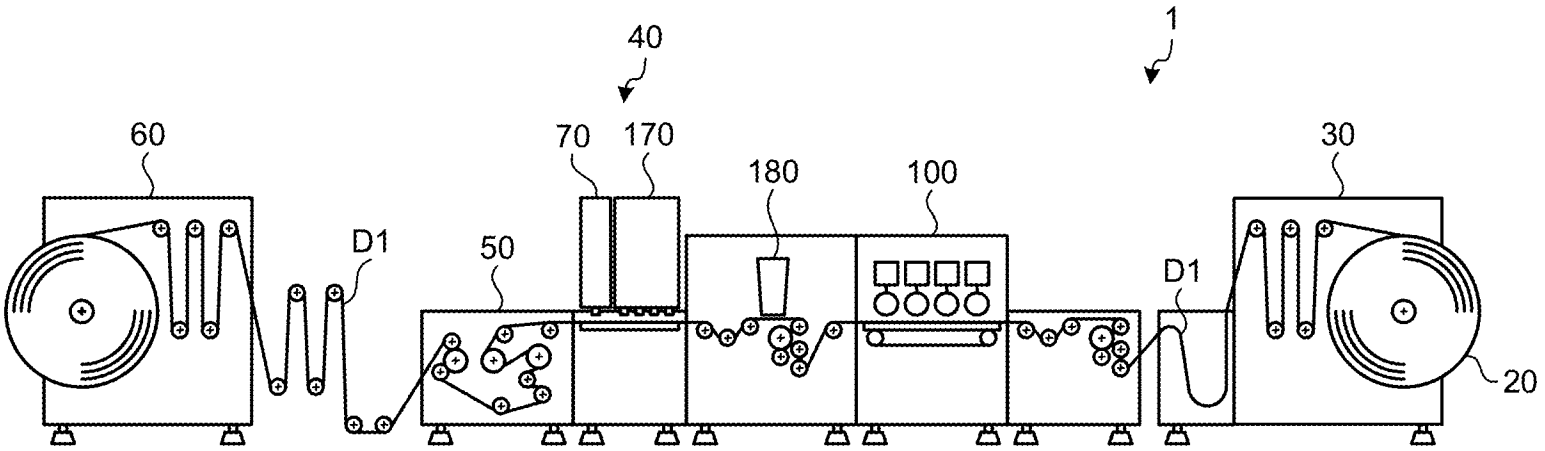
FIG. 3 is a pattern diagram of a schematic configuration of a printing apparatus (system) according to the embodiment.

FIG. 3 is a pattern diagram of a schematic configuration of a printing apparatus (system) 1 according to the present embodiment. As illustrated in FIG. 3, the printing apparatus (system) 1 includes a feeding unit 30 that feeds (conveys) the treatment object 20 (roll sheet) along a conveying path D1, a plasma treatment device 100 that performs a plasma treatment as a pretreatment on the fed treatment object 20, and an image forming device 40 that forms an image on the surface of the treatment object 20 subjected to the plasma treatment. These devices may be provided as separate housings, and all of which may be configured as the system, or may be installed in the same housing as a printing apparatus. When these devices are configured as a printing system, a control unit that controls the whole or part of the system may be included in any one of the devices or may be provided in any other independent housing.

The image forming device 40 includes an inkjet recording device 170 that forms an image, through inkjet processing, on the treatment object 20 subjected to the plasma treatment. The image forming device 40 may further include a post-processing unit 70 that performs post-processing on the treatment object 20 on which the image is formed. A pH detecting unit 180 used to detect a pH value of the surface of the treatment object 20 after the pretreatment performed by the plasma treatment device 100, is disposed between the plasma treatment device 100 and the image forming device 40. The printing apparatus (system) 1 may include a drying unit 50 that dries the post-processed treatment object 20 and a discharging unit 60 that discharges the treatment object 20 on which the image is formed (in some cases, the post-processing is further performed). As a pretreatment unit that performs a pretreatment on the treatment object 20, the printing apparatus (system) 1 may further include a primer treatment unit (not illustrated) that applies a treatment liquid, called a primer liquid including polymer materials, to the surface of the treatment object 20, in addition to the plasma treatment device 100. Furthermore, the printing apparatus (system) 1 includes a control unit (not illustrated) that controls the operations of the units. The control unit may be connected to a print control device that generates raster data from, for example, the image data as an object to be printed. The print control device may be provided inside the printing apparatus (system) 1 or may be provided outside the printing apparatus (system) 1 via a network such as the Internet or a local area network (LAN).

Figure 4:
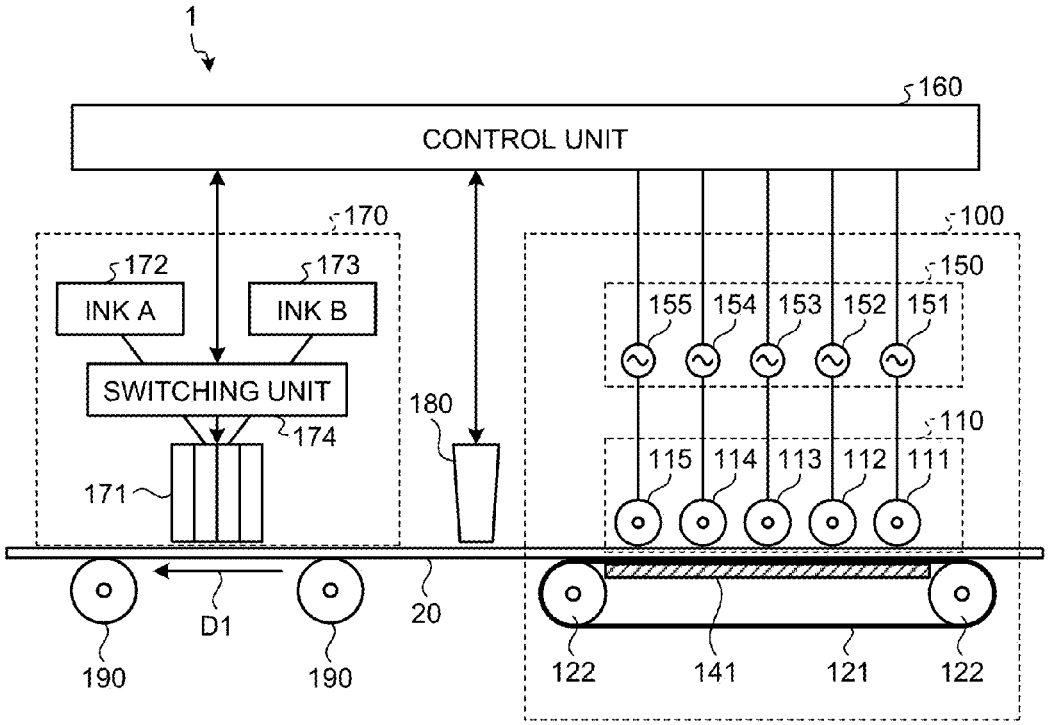
FIG. 4 is a pattern diagram selectively illustrating a configuration from the plasma treatment device to an inkjet recording device in the printing apparatus (system) according to the embodiment.

A configuration from the plasma treatment device 100 to the inkjet recording device 170 in the printing apparatus (system) 1 illustrated in FIG. 3 is selectively illustrated in FIG. 4. As illustrated in FIG. 4, the printing apparatus (system) 1 includes the plasma treatment device 100 that performs a plasma treatment on the surface of the treatment object 20, the pH detecting unit 180 that measures a pH value of the surface of the treatment object 20, the inkjet recording device 170 that forms an image on the treatment object 20 through inkjet recording, and a control unit 160 that controls the entire printing apparatus (system) 1. The printing apparatus (system) 1 includes conveying rollers 190 for conveying the treatment object 20 along the conveying path D1. The conveying rollers 190 are rotationally driven according to the control from, for example, the control unit 160, to convey the treatment object 20 along the conveying path D1.

Similarly to the atmospheric-pressure non-equilibrium plasma treatment device 10 illustrated in FIG. 2, the plasma treatment device 100 includes a discharge electrode 110, a ground electrode 141, a high-frequency high-voltage power supply 150, and a dielectric belt 121 disposed between these electrodes. As illustrated in FIG. 4, the discharge electrode 110 includes five discharge electrodes 111 to 115, and the ground electrode 141 is disposed along the area facing the discharge electrodes 111 to 115 across the dielectric belt 121. The high-frequency high-voltage power supply 150 includes five high-frequency high-voltage power supplies 151 to 155 according to the number of discharge electrodes 111 to 115, respectively.

An endless belt is preferably used as the dielectric belt 121 because it is also used for the purpose of conveying the treatment object 20. Therefore, the plasma treatment device 100 further includes rotating rollers 122 used to circulate the dielectric belt 121 and convey the treatment object 20 thereon. The rotating rollers 122 are rotationally driven based on an instruction from the control unit 160 to thereby circulate the dielectric belt 121. Accordingly, the treatment object 20 is conveyed along the conveying path D1.

The pH detecting unit 180 is disposed at a downstream side of the plasma treatment device 100, detects a pH value of the surface of the treatment object 20 subjected to the pretreatment (acidification treatment) performed by the plasma treatment device 100, and inputs the detected value to the control unit 160.

The control unit 160 can individually turn on/off the high-frequency high-voltage power supplies 151 to 155. The control unit 160 can also adjust a pulse intensity of a high-frequency and high-voltage pulse supplied from the high-frequency high-voltage power supplies 151 to 155 to the discharge electrodes 111 to 115, respectively.

The treatment object 20 passes through between the discharge electrode 110 and the dielectric belt 121 in the middle of generation of plasma in the plasma treatment device 100, so that the plasma treatment is performed on the treatment object 20. Thereby chains of a binder resin of the surface of the treatment object 20 are broken, and oxygen radical or ozone in the gas phase is re-combined with the polymer, so that the polar functional groups are generated on the surface of the treatment object 20. Consequently, hydrophilic property and acidification are given to the surface of the treatment object 20. In the present example, although the plasma treatment is performed in the atmosphere, it may be performed in a gas atmosphere such as nitrogen or rare gas.

The inkjet recording device 170 includes an inkjet head 171, a plurality of ink tanks 172 and 173 (two units in FIG. 4), and a switching unit 174 provided on ink channels between the inkjet head 171 and the two ink tanks 172 and 173. The ink tank 172 stores, for example, the ink A. The ink tank 173 stores, for example, the ink B having a property (see FIG. 1) different from that of the ink A.

The inkjet head 171 includes a plurality of heads for one color (for example, 4 colors×4 heads) in order to, for example, speed up a printing speed. To achieve high-resolution (e.g., 1200 dpi) image formation at a high speed, ink discharge nozzles of the heads in the colors are shifted and fixed so as to correct each interval. Moreover, the inkjet head 171 can be driven at a plurality of drive frequencies so that ink dots (droplets) discharged from the respective nozzles correspond to three sizes called a large droplet/a middle droplet/a small droplet.

The inkjet head 171 is disposed at the downstream side of the plasma treatment device 100 on the conveying path of the treatment object 20. The inkjet recording device 170 forms an image by discharging the inks to the treatment object 20 on which the plasma treatment device 100 performs the pretreatment (acidification treatment) based on the control from the control unit 160.

Figure 5:
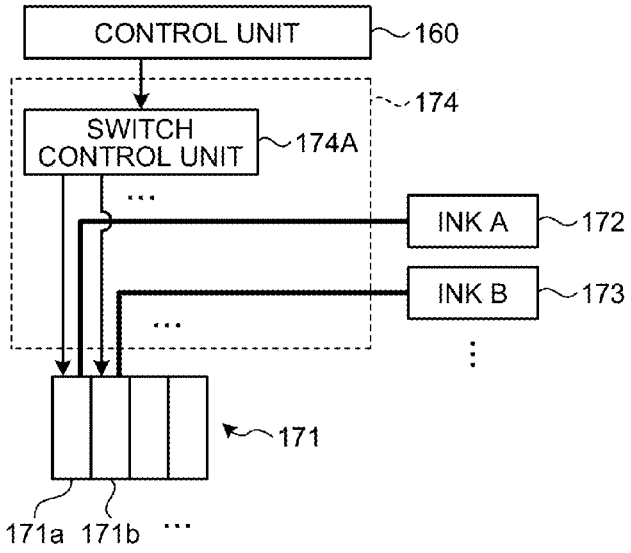
FIG. 5 is a pattern diagram of a schematic configuration example of a switching unit in FIG. 4.

In the present embodiment, the control unit 160 switches the ink to be used according to the pH value detected by the pH detecting unit 180. In other words, the control unit 160 controls the switching unit 174 according to the pH value detected by the pH detecting unit 180 and thereby switches the ink discharged from the inkjet head 171 to either one of the ink A and the ink B. Specifically, as illustrated in FIG. 5, the switching unit 174 includes a switch control unit 174A that independently drives a plurality of individual heads 171*a*, 171*b*, . . . provided in the inkjet head 171. The individual heads 171*a*, 171*b*, . . . are connected with the ink tanks 172, 173, . . . via individual ink channels, respectively. For example, when the ink A is to be used, the control unit 160 drives the individual head 171*a* connected to the ink tank 172 for the ink A. When the ink B is to be used, the control unit 160 drives the individual head 171*b* connected to the ink tank 173 for the ink B.

The present embodiment is not limited to the configuration in which the ink to be used is automatically switched by causing the control unit 160 to control the switching unit 174. For example, it may be configured that an individual inkjet head 171 is provided for each type of inks to be used and these inkjet heads are automatically switched to one another by the control unit 160 according to the ink to be used. Alternatively, it may be configured that when it is determined that an ink different from the currently set ink is to be used, the control unit 160 notifies the user to replace the ink to be used or an inkjet head containing the ink to be used. Alternatively, it may be configured that a switching valve is provided on the ink channels connecting the inkjet head and the multiple ink tanks to switch the ink to be supplied to the inkjet head under control of the switching valve when the ink to be used is switched.

The configuration as above allows the inks to be selectively used according to the treatment object 20 after the pretreatment, thus stably manufacturing high-quality printed materials while further suppressing the costs. In the explanation, it is assumed that the ink A, in which aggregation due to a pH reaction begins early, is stored in the ink tank 172 and the ink B, in which aggregation due to a pH reaction is slow, is stored in the ink tank 173.

Figure 6:
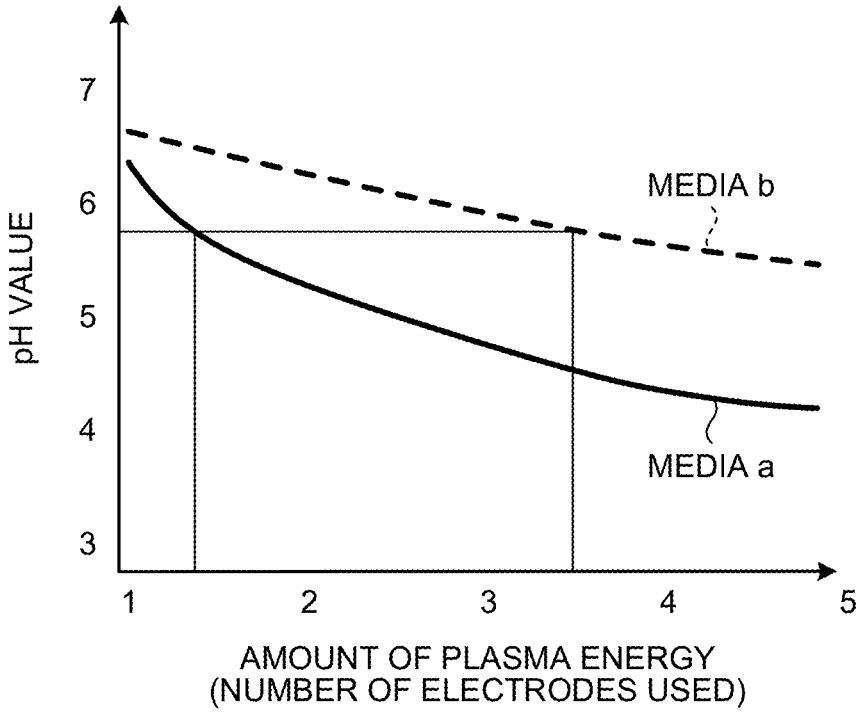
FIG. 6 is a diagram of an example of a relationship between an amount of plasma energy and a pH value of the surface of a treatment object for each medium.

FIG. 6 and Table 1 depict an example of a relationship between an amount of plasma energy (the number of the discharge electrodes 110 (hereinafter, "number of electrodes used")) used in the plasma treatment performed on two types of media a and media b each of which is the treatment object 20 and a pH value of the surface of the treatment object 20 after the plasma treatment. Table 1 lists the relationship illustrated in FIG. 6 as a table. As illustrated in FIG. 6 and Table 1, the amount of plasma energy per discharge electrode is set to 0.14 J/cm$^2$.

TABLE 1

| Measured Value of pH Value | | | | | | |
|---|---|---|---|---|---|---|
| | | Number of Electrodes Used | | | | |
| | | 1 | 2 | 3 | 4 | 5 |
| Type | Media a | 6.2 | 5.2 | 4.6 | 4.3 | 4.2 |
| | Media b | 6.5 | 6.2 | 6.1 | 5.9 | 5.7 |

0.14 J/cm$^2$ per electrode

As illustrated in FIG. 6 and Table 1, the pH value of the surface of the treatment object 20 tends to become lower with an increase in the number of electrodes used. In other words, the greater the total amount of plasma energy in one plasma treatment is made, the acidification of the surface of the treatment object tends to become higher. However, the change amount of the acidification of the surface of the treatment object with respect to the amount of plasma energy differs depending on the type of the treatment object 20. In the examples of FIG. 6 and Table 1, the pH value of the media a tends to become lower than that of the media b.

The data illustrated in FIG. 6 and Table 1 can be obtained by forming five types of areas with a different number of electrodes used in the plasma treatment by performing plasma discharge while sequentially selecting the number of electrodes used in the plasma treatment from one unit to five units, and by measuring the pH value of each area in the pH detecting unit 180. These data is preferably stored on, for example, a memory (not illustrated) connected to the control unit 160. In this case, the stored data can be used as data for calibration when an optimal parameter for the pretreatment is calculated from the pH value detected by the pH detecting unit 180 at the time of actual operation of the printing apparatus (system) 1. In the example, the number of the discharge electrodes 110 is set to five; however, the embodiment is not limited thereto. Therefore, it is preferable that any number of discharge electrodes 110 necessary to obtain a required pH value is installed. In that case, the data for calibration may be measured for each number of units to be installed, or the data may be measured at each interval of predetermined units (for example, intervals of every two electrodes). Furthermore, when the primer treatment is used as the pretreatment, the amount of plasma energy (number of electrodes used) is only replaced with the coating amount of the primer liquid. When the primer treatment and the plasma treatment are combined, a combination of the amount of plasma energy (number of electrodes used) and the coating amount of the primer liquid is simply set as a parameter. In other words, the parameter indicating the level of the treatment executed as the pretreatment is simply managed in association with the acidification.

As explained with reference to FIG. 1, the pH value required for aggregating pigments contained in an ink differs depending on the properties of the ink. Therefore, a required number of electrodes when the treatment object and the ink are combined is represented in Table 2. The required number of electrodes is the number of the discharge electrodes 110 necessary to obtain the pH value required for aggregation of the pigments contained in the ink. As illustrated in Table 2, also, the amount of plasma energy per discharge electrode is set to 0.14 J/cm$^2$.

TABLE 2

| Type | Ink A | Ink B | Required Number of Electrodes |
|---|---|---|---|
| Media a | ○ | | 2 |
| Media a | | ○ | 3 |
| Media b | ○ | | 4 |
| Media b | | ○ | Unusable |

As illustrated in Table 2, when the ink A is used, the pH value at which the aggregation reaction starts is 6.1. Therefore, when the media a is used, the required number of electrodes is two units, and when the media b is used, the required number of electrodes is four units. Meanwhile, when the ink B is used, the pH value at which the aggregation reaction starts is 5.2. Therefore, when the media a is used, the required number of electrodes is three units, while when the media b is used, the necessary pH value cannot be obtained even if all (five units) the installed discharge electrodes 110 are used. In this case, for a combination of the ink B and the media b, the required number of electrodes may be represented as Unusable as illustrate in Table 2, or the number of discharge electrodes 110 to be installed in the plasma treatment device 100 may be increased, or the amount of plasma energy per each discharge electrode may be increased, or a plasma treatment may be divided into a plurality of treatments to be performed by reciprocally conveying the treatment object 20.

As a method for decreasing the pH value of the surface of the treatment object 20 to a required one, there is a method of increasing a time for plasma treatment in addition to a method of switching the number of electrodes to be driven and increasing or decreasing the amount of plasma energy. The method of increasing the time for plasma treatment can be implemented by using, for example, a method of delaying the conveying speed of the treatment object 20 and a method of turning back the treatment object 20 along the conveying path D1 and performing the plasma treatment thereon a plurality of times. However, if image recording is performed on the treatment object 20 at a high speed, the time for plasma treatment is desired to be reduced. The method of reducing the time for plasma treatment may include, as explained above, a method for providing a plurality of discharge electrodes 111 to 115 and driving a required number of the discharge electrodes 111 to 115 according to the printing speed and the required pH value and a method for adjusting the intensity of the amount of plasma energy to be given to each of the discharge electrodes 111 to 115. However, the embodiment is not limited thereto, and therefore a method of combining the methods and some other methods can be changed accordingly.

Therefore, the control unit 160 according to the present embodiment may select the number of units to be driven among the high-frequency high-voltage power supplies 151 to 155 in a proportion to, for example, printing speed information, may adjust a pulse intensity of a high-frequency high-voltage pulse supplied from each of the high-frequency high-voltage power supplies 151 to 155 to each of the discharge electrodes 111 to 115, may adjust a conveying speed of the treatment object 20 by controlling the rotational speed of the conveying rollers 190, may turn back the treatment object 20 by reversely rotating the conveying rollers 190, or may execute these controls in combination. The printing speed information may be information such as print mode (color printing, black and white printing, or resolution etc.) in the inkjet recording device 170 or may be information such as a rotational speed of the conveying rollers 190 and a throughput derived from the information. The pulse intensity corresponds to the amount of plasma energy, and may be a frequency and a voltage value (amplitude) of a high-frequency high-voltage pulse, or may be a control value calculated from these parameters.

The amount of plasma energy required for the plasma treatment may differ depending on a type of media. In this case, the control unit 160 may select the number of units to be driven of the high-frequency high-voltage power supplies 151 to 155, according to the type of media, may adjust a pulse intensity of a high-frequency high-voltage pulse supplied from each of the high-frequency high-voltage power supplies 151 to 155 to each of the discharge electrodes 111 to 115, may adjust a conveying speed of the treatment object 20 by controlling the rotational speed of the conveying rollers 190, may turn back the treatment object 20 by reversely rotating the conveying rollers 190, or may execute these controls in combination.

The behavior of a pigment contained in an ink differs depending on the properties of the ink, as explained above. Therefore, the control unit 160 may select the number of units to be driven of the high-frequency high-voltage power supplies 151 to 155 according to the type (property etc.) of an ink to be used, may adjust a pulse intensity of a high-frequency high-voltage pulse supplied from each of the high-frequency high-voltage power supplies 151 to 155 to each of the discharge electrodes 111 to 115, may adjust a conveying speed of the treatment object 20 by controlling the rotational speed of the conveying rollers 190, may turn back the treatment object 20 by reversely rotating the conveying rollers 190, or may execute these controls in combination.

Furthermore, the control unit 160 may adjust the pH value of the surface of the treatment object 20 after the pretreatment by feedback-controlling the plasma treatment device 100 based on the pH value received from the pH detecting unit 180.

The amount of plasma energy required for the plasma treatment can be calculated from a voltage value and an application time of the high-frequency high-voltage pulse supplied from each of the high-frequency high-voltage power supplies 151 to 155 to each of the discharge electrodes 111 to 115, and from a current passing through the treatment object 20 at that time. The amount of plasma energy required for the plasma treatment may be controlled as a whole amount of energy of the discharge electrodes 110 not as each of the discharge electrodes 111 to 115.

If the discharge electrodes 111 to 115 are provided, it is effective in uniform acidification of the surface of the treatment object 20. In other words, for example, when conveying speeds (or printing speeds) are the same as each other, the time during which the treatment object 20 passes through a plasma space can be made longer in a case where the acidification treatment is performed by a plurality of discharge electrodes than in a case where the acidification treatment is performed by a single discharge electrode. Accordingly, the acidification treatment can be more uniformly performed on the surface of the treatment object 20.

Figure 7:
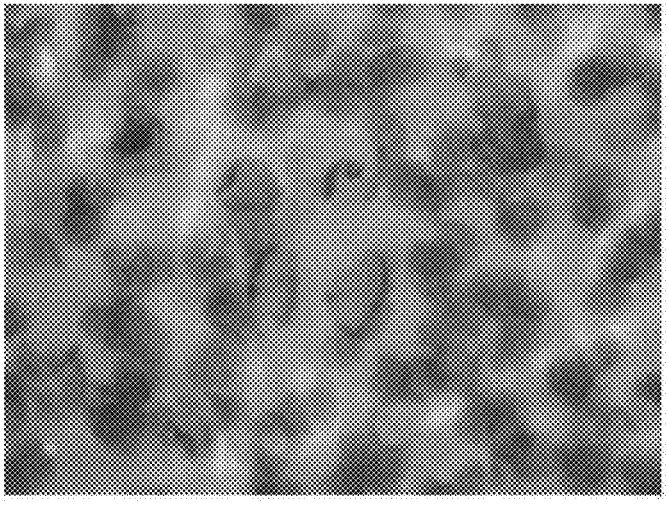
FIG. 7 is an enlarged diagram of an image obtained by capturing an image forming surface of a printed material which is obtained by performing inkjet recording processing on the treatment object that is not subjected to the plasma treatment according to the embodiment.
Figure 8:
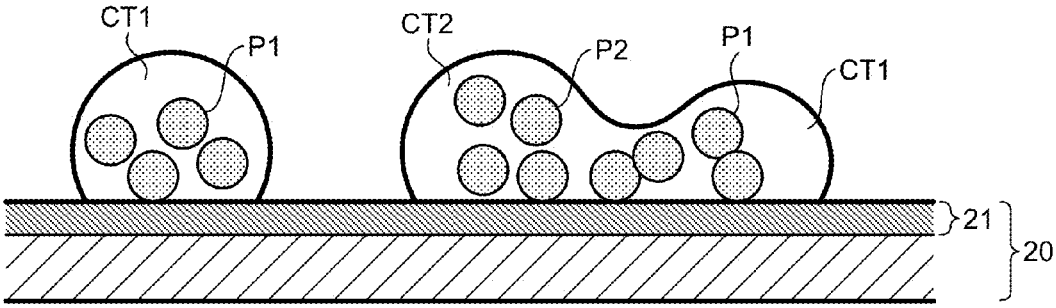
FIG. 8 is a pattern diagram of an example of dots formed on the image forming surface of the printed material in FIG. 7.
Figure 9:
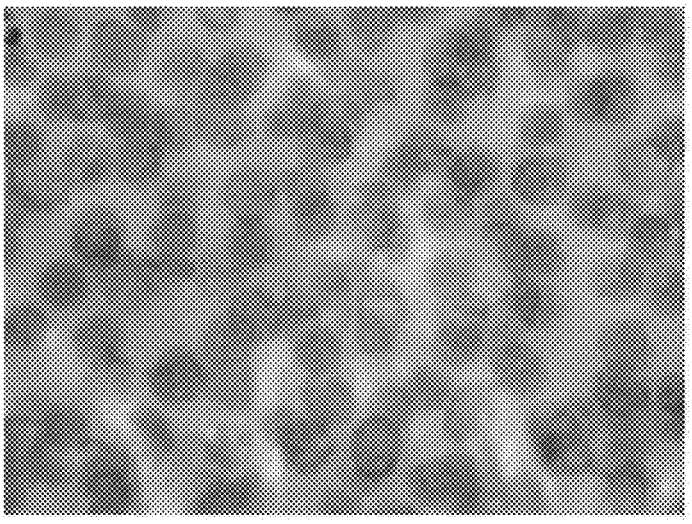
FIG. 9 is an enlarged diagram of an image obtained by capturing an image forming surface of the printed material which is obtained by performing inkjet recording processing on the treatment object that is subjected to the plasma treatment according to the embodiment.
Figure 10:
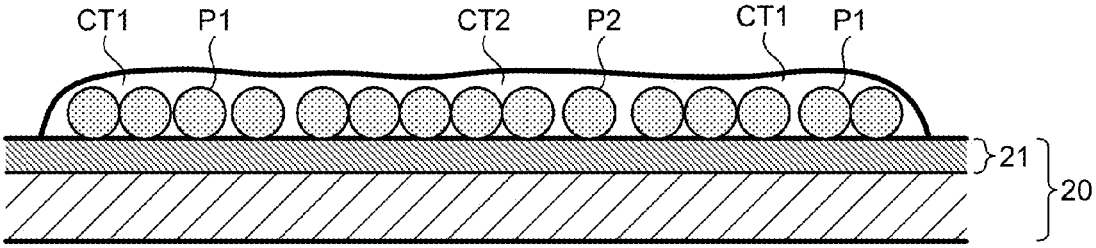
FIG. 10 is a pattern diagram of an example of dots formed on the image forming surface of the printed material in FIG. 9.

A difference in printed materials between a case of subjecting the plasma treatment to the treatment object and a case of not subjecting the plasma treatment to the treatment object will be explained below with reference to FIG. 7 to FIG. 10. FIG. 7 is an enlarged diagram of an image obtained by capturing an image forming surface of a printed material which is obtained by performing inkjet recording processing on the treatment object that is not subjected to the plasma treatment according to the embodiment. FIG. 8 is a pattern diagram of an example of dots formed on the image forming surface of the printed material in FIG. 7. FIG. 9 is an enlarged diagram of an image obtained by capturing an image forming surface of the printed material which is obtained by performing inkjet recording processing on the treatment object that is subjected to the plasma treatment according to the embodiment. FIG. 10 is a pattern diagram of an example of dots formed on the image forming surface of the printed material in FIG. 9. A desk top type inkjet recording device is used to obtain the printed material illustrated in FIG. 7 and FIG. 9. An ordinary coated paper with a coated layer is used for the treatment object 20.

The coated paper not subjected to the plasma treatment according to the embodiment has less wettability in the coated layer on the surface of the coated paper. Therefore, in the image formed through inkjet recording processing performed on the coated paper that is not subjected to the plasma treatment, the shape of a dot (shape of a vehicle CT1) attached to the surface of the coated paper when the dot is landed is deformed as illustrated in FIG. 7 and FIG. 8. When neighboring dots are formed before the dots are dried sufficiently, as illustrated in FIG. 7 and FIG. 8, vehicles CT1 and CT2 coalesce when the neighboring dots are landed on the coated paper, and this causes movement (color mixture) of pigments P1 and P2 between the dots, which may result in uneven density due to beading or so.

On the other hand, for the coated paper subjected to the plasma treatment according to the embodiment, the wettability of the coated layer on the surface of the coated paper is improved. Therefore, in the image formed through the inkjet recording processing performed on the coated paper that is subjected to the plasma treatment, as illustrated in FIG. 9, for example, the vehicles CT1 spread in a comparatively flat circle over the surface of the coated paper. Accordingly, the dots are made flat as illustrated in FIG. 10. In addition, the surface of the coated paper becomes acidity caused by the polar functional groups formed by the plasma treatment, and therefore the ink pigments are electrically neutralized, the pigments P1 are aggregated, and the viscosity of the ink is increased. Therefore, even when the vehicles CT1 and CT2 coalesce as illustrated in FIG. 10, the movement (color mixture) of pigments P1 and P2 between the dots can be suppressed. Furthermore, because the polar functional groups are generated inside the coated layer, the permeability of the vehicle CT1 is increased. Therefore, the pigments can be dried in a comparatively short time. The dots spreading in a circular shape due to improvement in the wettability are aggregated while penetrating, and the pigments P1 are thereby uniformly aggregated in their height direction, thus suppressing occurrence of uneven density due to beading or so. FIG. 8 and FIG. 10 are only pattern diagrams, and in actual cases, the pigments are aggregated to form a layer also in a case of FIG. 10.

In this way, in the treatment object 20 subjected to the plasma treatment according to the embodiment, hydrophilic functional groups are generated on the surface of the treatment object 20 due to the plasma treatment and the wettability is improved. As a result of formation of the polar functional groups due to the plasma treatment, the surface of the treatment object 20 is acidified. Thereby the landed ink is uniformly spread over the surface of the treatment object 20, the negatively charged pigments are neutralized on the surface of the treatment object 20 to be aggregated, so that the viscosity thereof increases. Consequently, the movement of the pigments can be suppressed even if the dots coalesce. The polar functional groups are generated inside the coated layer formed on the surface of the treatment object 20, and the vehicles are thereby quickly penetrated into the inside of the treatment object 20. Therefore, the drying time can be reduced. In other words, the dots spreading in a circular shape due to improvement in the wettability are penetrated into the inside thereof while the movement of the pigments is suppressed due to the aggregation, thus maintaining the dot in a shape near an exact circle.

Figure 11:
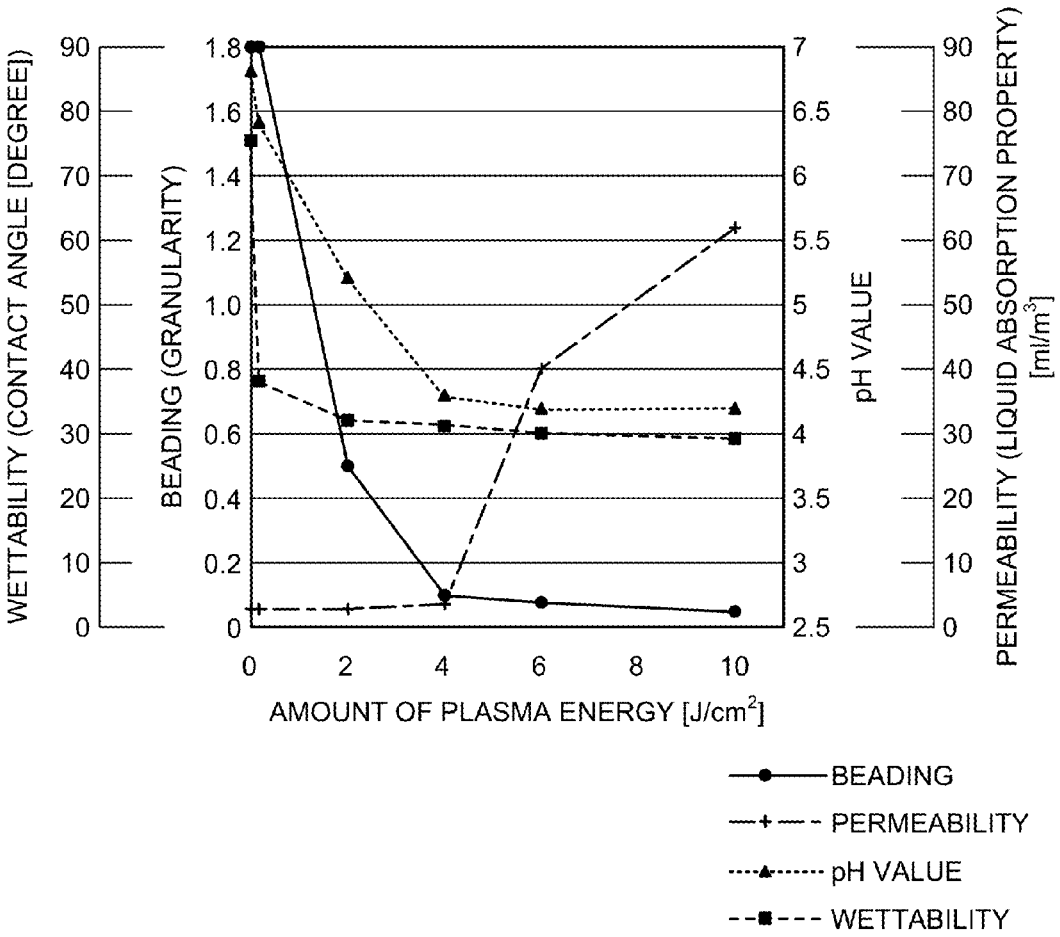
FIG. 11 is a graph representing a relationship between an amount of plasma energy, wettability of the surface of the treatment object, beading, a pH value, and permeability according to the embodiment.

FIG. 11 is a graph representing a relationship between an amount of plasma energy according to the embodiment, a wettability of the surface of the treatment object, beading, a pH value, and permeability. FIG. 11 represents how the surface properties (the wettability, the beading, the pH value, and the permeability (liquid absorption property)) when an image is printed on the coated paper as the treatment object 20 are dependent on the amount of plasma energy and how the surface properties are changed thereby. To obtain the evaluation illustrated in FIG. 11, an aqueous pigment ink (alkaline ink in which negatively charged pigments are dispersed) having a property in which pigments are aggregated due to acid was used for the ink.

As illustrated in FIG. 11, the wettability of the surface of the coated paper is sharply increased when the amount of plasma energy is low (e.g., about 0.2 $J/cm^2$ or lower), and is not improved much even if the energy is increased more than that. On the other hand, the pH value of the surface of the coated paper is decreasing to a certain extent with an increase in the amount of plasma energy. However, saturation occurs when the amount of plasma energy exceeds a certain value (e.g., about 4 $J/cm^2$). The permeability (liquid absorption property) is rapidly improved around a point where the decrease in the pH value is saturated (e.g., about 4 $J/cm^2$). However, the phenomenon varies depending on the polymer component contained in the ink.

As a result, the value of beading (granularity) is in very good condition after the permeability (liquid absorption property) begins to improve (e.g., about 4 $J/cm^2$). The beading (granularity) in this case represents the degree of roughness of the image by values, and represents the density unevenness by standard deviation of an average density. As illustrated in FIG. 11, densities of a color solid image formed from dots of two colors or more are sampled a plurality of times, and the standard deviation of the densities is represented as the beading (granularity). In this way, the ink discharged to the coated paper subjected to the plasma treatment according to the embodiment spreads in the exact circle and penetrates into the coated paper while being aggregated, thus improving the beading (granularity) of the image.

As explained above, in the relationship between the property of the surface of the treatment object 20 and the image quality, the dot circularity improves with improvement of the wettability of the surface. This is because the wettability of the surface of the treatment object 20 is improved and uniformed due to an increase in the surface roughness and hydrophilic polar functional groups generated through the plasma treatment. Furthermore, water repellent factors such as foreign particles, oil, and calcium carbonate on the surface of the treatment object 20 are removed by the plasma treatment, which is thought one of factors of the improvement. In other words, as a result of improving the wettability of the surface of the treatment object 20 and removing the destabilizing factors from the surface of the treatment object 20, the droplet is evenly spread in its circumferential direction, thus the dot circularity is improved.

Moreover, by acidifying the surface of the treatment object 20 (reducing pH), the ink pigments are aggregated, the permeability is improved, and the vehicle penetrates into the inside of the coated layer. Therefore, the pigment density on the surface of the treatment object 20 increases, so that even if the dots coalesce, the movement of the pigments can be suppressed. Accordingly, it is possible to suppress pigment mixture and to evenly settle the pigments on the surface of the treatment object 20 and aggregate them. However, the suppressing effect on pigment mixture varies depending on the components of the ink and the size of the ink droplet. For example, when the size of the ink droplet is a small droplet, the pigment mixture due to coalescence of dots is hard to occur as compared with a large droplet. This is because when the vehicle size is a small droplet, the vehicle more quickly dries and penetrates and because the pigments can be aggregated at a low pH reaction. The effect of the plasma treatment fluctuates depending on the type of the treatment object 20 and environments (humidity, etc.). Therefore, the amount of plasma energy in the plasma treatment may be controlled to an optimal value according to the size of the droplet, the type of the treatment object 20, the environments, and the like. Consequently, the efficiency of surface modification of the treatment object 20 is improved, and further energy saving may be achieved.

Figure 12:
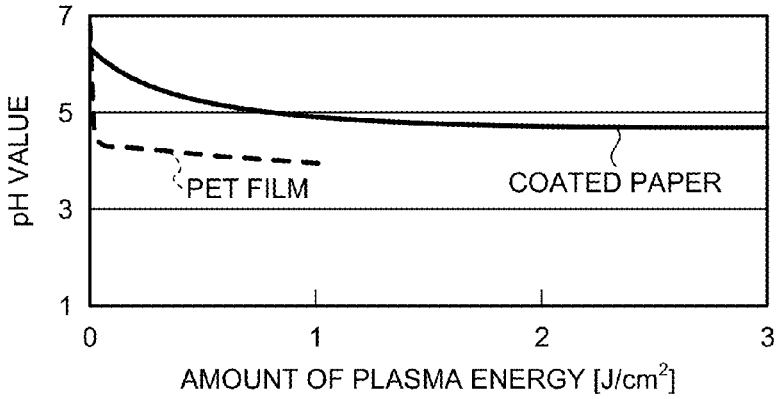
FIG. 12 is a graph representing a relationship between an amount of plasma energy and a pH value according to the embodiment.

FIG. 12 is a graph representing a relationship between an amount of plasma energy and a pH value according to the embodiment. The pH is generally measured in a solution, but, recently, the pH of the solid surface can be measured. A measuring instrument is, for example, a pH meter B-211 manufactured by HORIBA Ltd.

In FIG. 12, a solid line represents plasma energy dependence of the pH value of the coated paper, and a dotted line represents plasma energy dependence of the pH value of PET film. As illustrated in FIG. 12, the PET film is acidified by less amount of plasma energy as compared with that of the coated paper. However, even in the coated paper, the amount of plasma energy at the time of acidification is about 3 $J/cm^2$ or less. When an image is recorded by an inkjet processing device that discharges alkaline aqueous pigment ink to the treatment object 20 of which pH value becomes 5 or less, the dot of the formed image was formed as a shape close to an exact circle. A satisfactory image without pigment mixture due to coalescence of dots and without blurring was obtained (see FIG. 9).

Therefore, in the embodiment, as illustrated in FIG. 4, the pH detecting unit 180 for solid is disposed at the downstream side of the plasma treatment device 100 which is an acidification treatment unit, and information on the pH of the surface of the treatment object 20 is read by the pH detecting unit 180. Feedback control or feedforward control is performed on the plasma treatment device 100 based on the information on the read pH, so that the pH value of the surface of the treatment object 20 is reduced to a predetermined value (e.g., pH=5) or less.

Figure 13:
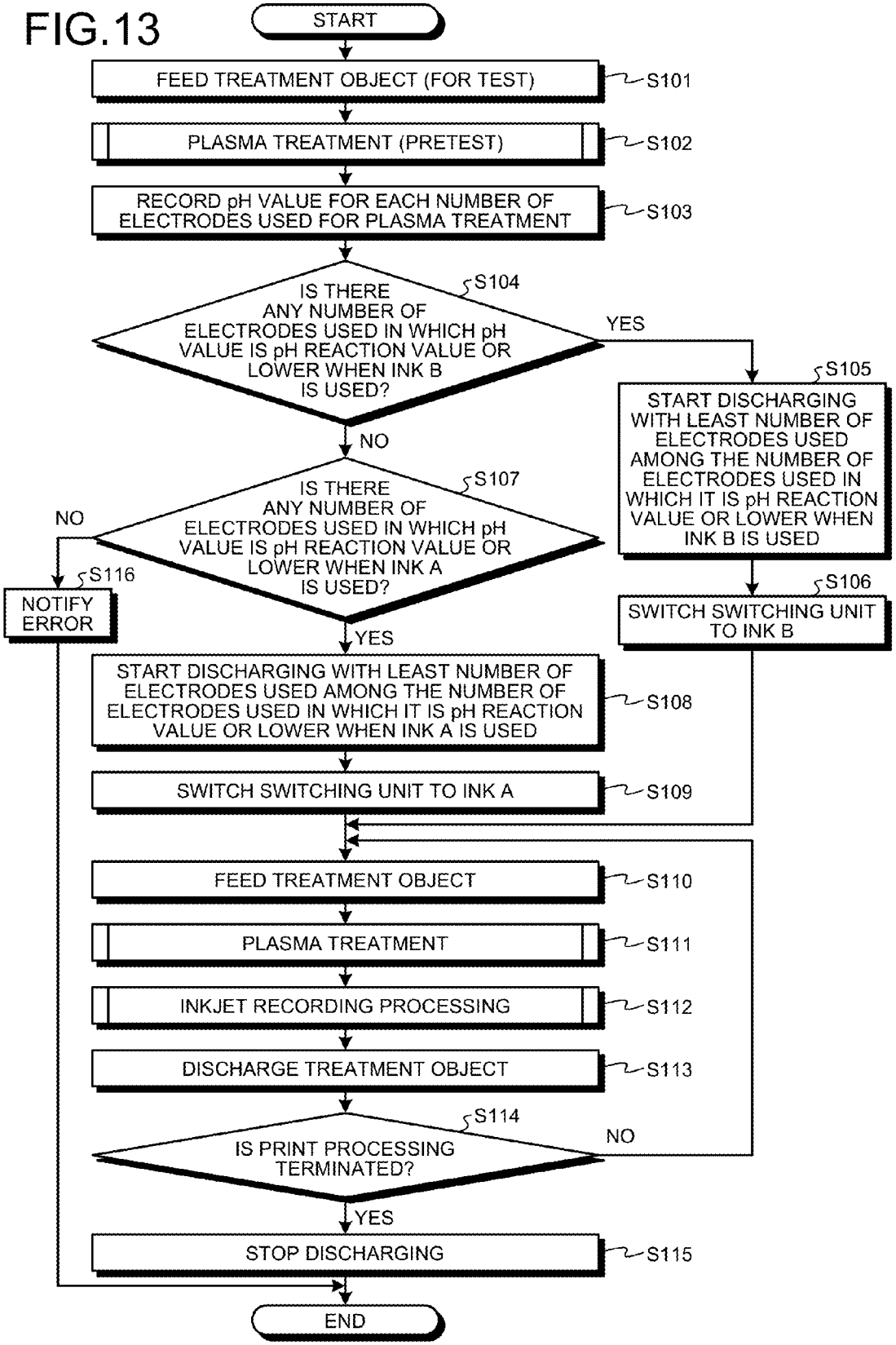
FIG. 13 is a flowchart of an example of print processing according to the embodiment.

The print processing according to the embodiment will be explained in detail below with reference to the accompanying drawings. FIG. 13 is a flowchart of an example of the print processing according to the embodiment. In the example in FIG. 13, the printing apparatus (system) 1 illustrated in FIG. 4 is used, the two types of the ink A and the ink B illustrated in FIG. 1 are used as the ink, and the cut sheet (printing medium cut to a predetermined size) is used as the treatment object 20. The same print processing is applicable to the roll sheet instead of the cut sheet.

As illustrated in FIG. 13, in the print processing, first of all, the control unit 160 drives the feeding unit (see FIG. 3) to feed the treatment object 20 to the conveying path D1 (Step S101). The treatment object 20 is the one for a test used for the plasma treatment as a pretest.

Then, when the treatment object 20 is conveyed up to the plasma treatment device 100, the control unit 160 drives the plasma treatment device 100 to perform the plasma treatment as the pretest on the treatment object 20 (Step S102). In the plasma treatment as the pretest, the number of the electrodes used in a plurality of patterns is used to perform the plasma treatment. The details of the plasma treatment will be explained later with reference to FIG. 14.

Subsequently, the control unit 160 measures the pH value of the surface of the treatment object 20 subjected to the plasma treatment as the pretest for each number of the discharge electrodes 110 (number of electrodes used) used for the plasma treatment, and records the measured pH value associated with each number of electrodes used in a predetermined memory (not illustrated) (Step S103).

The control unit 160 determines whether there is a pH value which is lower than the pH reaction value (the acidification is higher) required for the surface of the treatment object 20 when the ink B is used, among the pH values recorded at Step S103 (Step S104). When there is a pH value lower than the pH reaction value in the case of the ink B (YES at Step S104), the control unit 160 identifies the number of electrodes used corresponding to the pH value lower than the pH reaction value in the case of the ink B, drives the plasma treatment device 100 with a least number of electrodes used among the identified number, and thereby starts discharging (Step S105). The control unit 160 switches the switching unit 174 illustrated in FIG. 4 to the ink tank 173 for the ink B (Step S106), and proceeds to Step S110. Thereby, the ink B stored in the ink tank 173 is supplied to the inkjet head 171.

Meanwhile, when there is no pH value lower than the pH reaction value in the case of the ink B (NO at Step S104), the control unit 160 further determines whether there is a pH value lower than the pH reaction value required for the surface of the treatment object 20 when the ink A is used (Step S107). When there is a pH value lower than the pH reaction value in the case of the ink A (YES at Step S107), then the control unit 160 identifies the number of electrodes used corresponding to the pH value lower than the pH reaction value in the case of the ink A, drives the plasma treatment device 100 with a least number of electrodes used among the identified number, and thereby starts discharging (Step S108). The control unit 160 switches the switching unit 174 illustrated in FIG. 4 to the ink tank 172 for the ink A (Step S109), and proceeds to Step S110. Thereby, the ink A stored in the ink tank 172 is supplied to the inkjet head 171. However, when there is no pH value lower than the pH reaction value in the both cases of the ink A and the ink B (NO at Step S104, NO at Step S107), the control unit 160 notifies the user of an error (Step S116), and ends the present operation.

At Step S110, the control unit 160 drives the feeding unit 30 (see FIG. 3) to actually feed the treatment object 20 for printing an image to the conveying path D1. Subsequently, the control unit 160 drives a conveying roller (not illustrated) and the rotating rollers 122 in the plasma treatment device 100 to perform the plasma treatment on the treatment object 20 when the treatment object 20 is passing through the plasma treatment device 100 while being conveyed along the conveying path D1 (Step S111). Then, the control unit 160 drives the inkjet recording device 170 to perform the inkjet recording processing on the treatment object 20 subjected to the plasma treatment (Step S112), and discharges the treatment object 20 on which the image is thereby formed from the discharging unit 60 (Step S113). The control unit 160 may perform post-processing as necessary before discharging the treatment object 20.

The control unit 160 determines whether the print processing is to be terminated (Step S114). When it is not to be terminated (NO at Step S114), for example, when there still remains some print data, the control unit 160 returns to Step S110, and, thereafter, repeatedly performs the same operation until the inkjet recording processing on all the print data is completed. Meanwhile, when the print processing is to be terminated (YES at Step S114), the control unit 160 stops discharging in the plasma treatment device 100 (Step S115), and ends the present operation.

Figure 14:
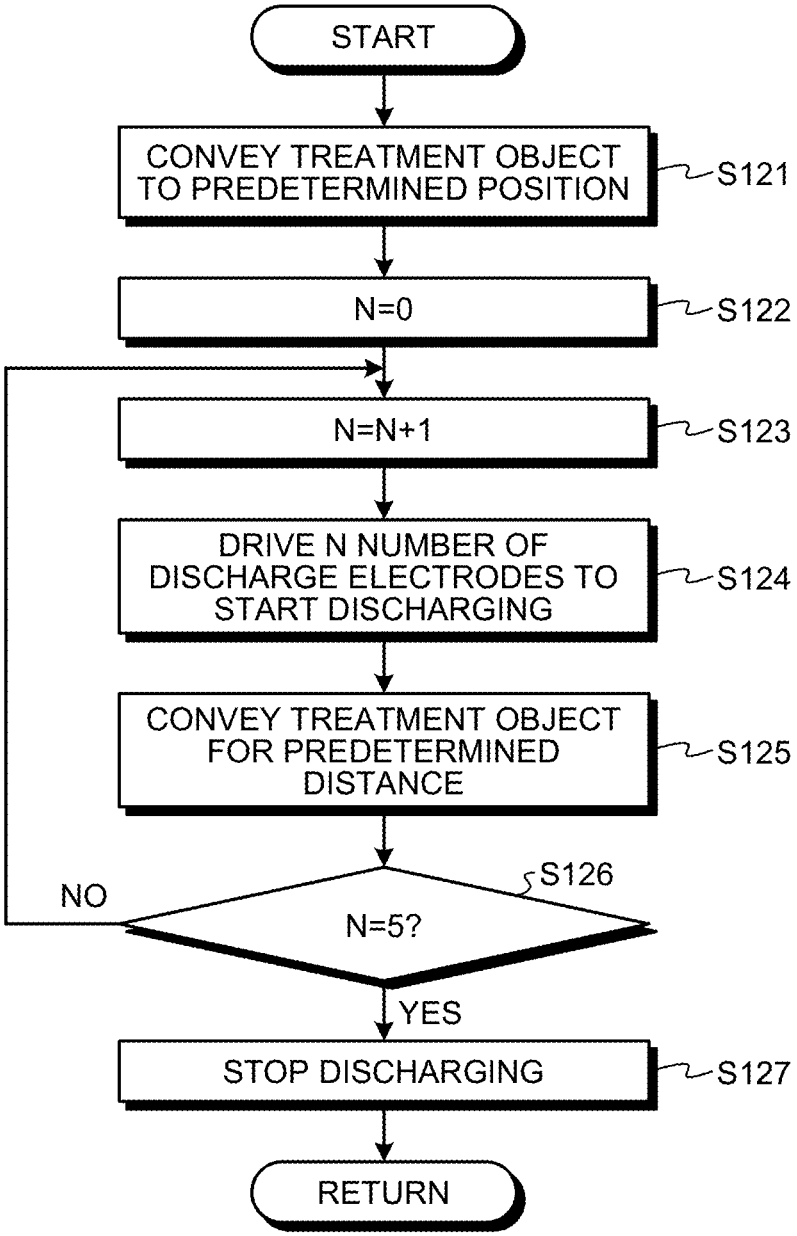
FIG. 14 is a flowchart of an example of plasma treatment as a pretest at Step S102 of FIG. 13.

FIG. 14 represents an example of the plasma treatment as a pretest performed at Step S102 in FIG. 13. In FIG. 14, the number of the discharge electrodes 110 in the plasma treatment device 100 is set to 5.

As illustrated in FIG. 14, in the plasma treatment as the pretest, the control unit 160 drives the conveying roller (not illustrated) and the rotating rollers 122 in the plasma treatment device 100 to convey the treatment object 20 fed to the conveying path D1 from the feeding unit 30 up to a predetermined position in the plasma treatment device 100 (Step S121). The predetermined position may be a position between at least one of the discharge electrodes 111 to 114 and the counter electrode 141.

Subsequently, the control unit 160 resets a counter value N (not illustrated) to 0 (Step S122), and then adds 1 to the counter value N (Step S123). Therefore, the counter value N at this stage is 1.

The control unit 160 drives an arbitrary number of discharge electrodes 110 corresponding to the value of the counter value N to start discharging (Step S124). Subsequently, the control unit 160 drives the rotating rollers 122 (also the conveying rollers 190 if necessary) to convey the treatment object 20 for a predetermined distance (Step S125).

The control unit 160 determines whether the counter value N reaches 5 (Step S126). When it reaches 5 (YES at Step S126), the control unit 160 causes the plasma treatment device 100 to stop discharging (Step S127), and, thereafter, returns to the operation illustrated in FIG. 13. Meanwhile, when the counter value N does not reach 5 (NO at Step S126), then the control unit 160 returns to Step S123, and repeatedly performs subsequent operations until the counter value N reaches 5.

With these operations, a plurality of areas subjected to the plasma treatment with different amounts of plasma energies (number of electrodes used) are formed on the surface of the treatment object 20. At Step S103 in FIG. 13, the control unit 160 measures a pH value in each of the areas, and records the measured pH value for each of the areas associated with the number of discharge electrodes 110 used in the plasma treatment performed on each of the areas.

In the operation as illustrated in FIG. 13, when a roll sheet is used as the treatment object 20, the control unit 160 may perform the plasma treatment as a pretest by using a leading portion of the treatment object 20 fed by the feeding unit 30 and acquire a pH value for each number of electrodes used at Steps S101 to S109. When the roll sheet is used, the property of a single roll hardly changes, and therefore after the amount of plasma energy is adjusted by using the leading portion, stable and continuous printing becomes possible without changing the setting. However, if the device is stopped for a long time without using all the length of the roll sheet, then the property of the sheet may change. Therefore, the plasma treatment as the pretest may be performed again by using the leading portion in the same manner as that before restart of the printing, to acquire a pH value for each number of electrodes used.

FIG. 13 exemplifies the case where the processing from the plasma treatment as the pretest to the actual inkjet recording processing is performed through a series of flow; however, the embodiment is not limited thereto. In other words, the operation for performing the plasma treatment as the pretest and recording a pH value for each number of electrodes used can be performed separately from the operation for switching between inks to be used according to the pH value for each number of electrodes used and performing inkjet recording processing.

Figure 15:
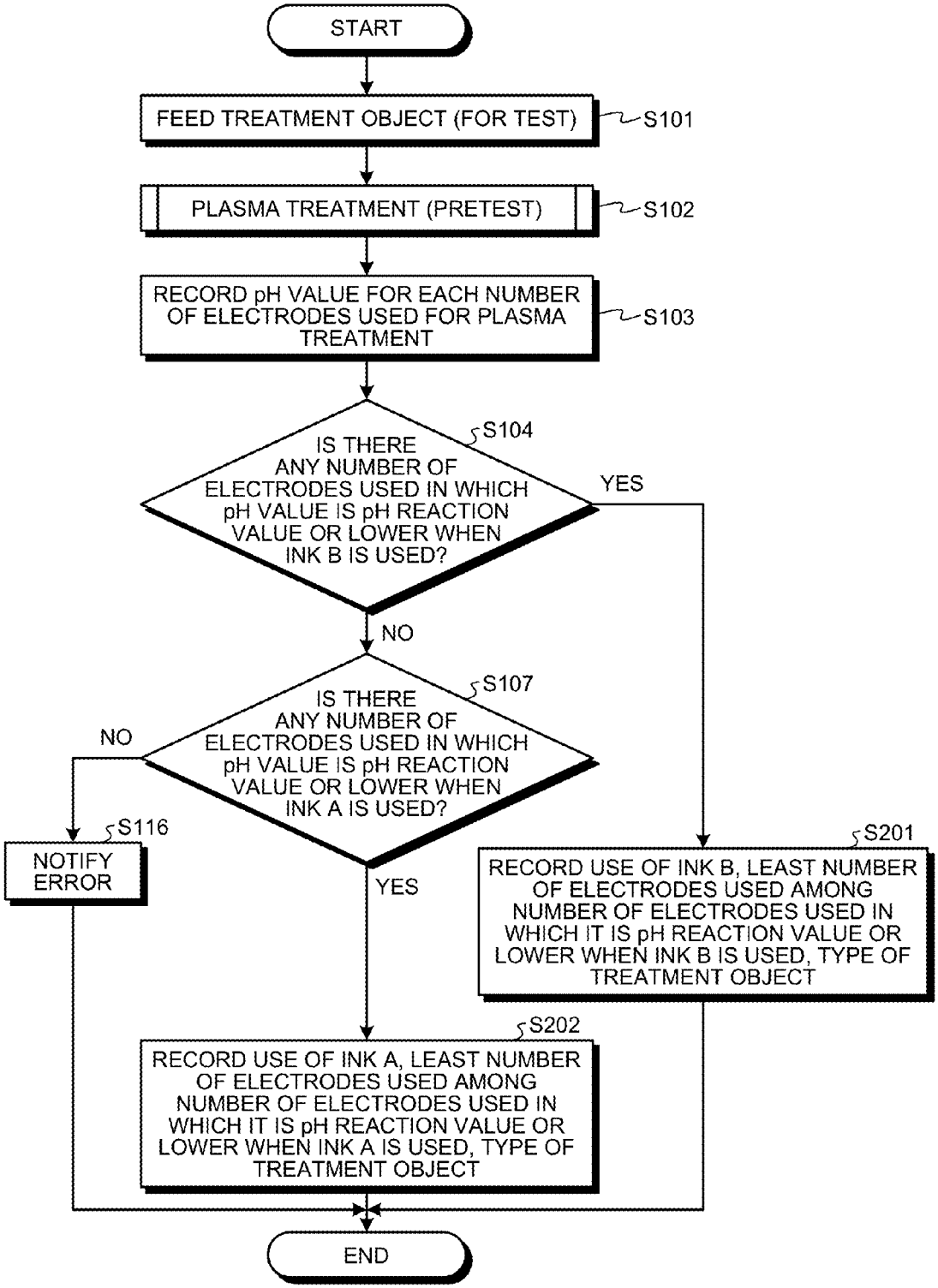
FIG. 15 is a flowchart of an example of operations for performing the plasma treatment as a pretest according to the embodiment and recording a pH value for each number of electrodes used.
Figure 16:
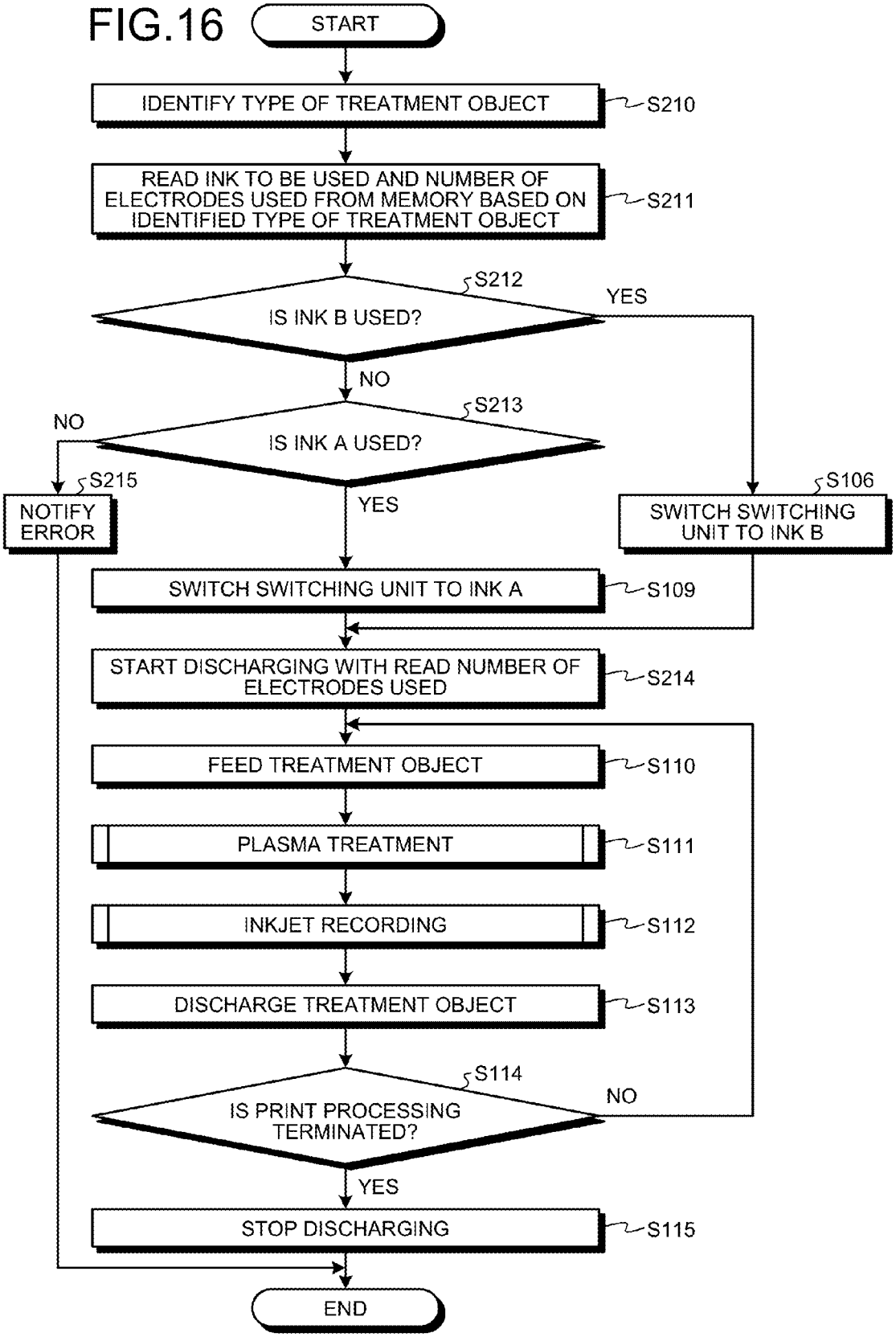
FIG. 16 is a flowchart of an example of operations for switching between inks to be used according to the pH value for each number of electrodes used according to the embodiment and performing inkjet recording processing.

FIG. 15 is a flowchart of an example of operations for performing the plasma treatment as a pretest and recording the pH value for each number of electrodes used. FIG. 16 is a flowchart of an example of operations for switching between inks to be used according to the pH value for each number of electrodes used and performing inkjet recording processing.

First of all, as illustrated in FIG. 15, in the operation for performing the plasma treatment as a pretest and recording the pH value for each number of electrodes used, the control unit 160 performs the operations the same as these at Steps S101 to S103 in FIG. 13, that is, performs the plasma treatment as the pretest on the fed treatment object 20, and records the measured pH value associated with the number of electrodes used and the type of the fed treatment object 20 in a predetermined memory (not illustrated).

Then, similarly to Step S104 in FIG. 13, the control unit 160 determines whether there is a pH value which is lower than the pH reaction value (the acidification is higher) required for the surface of the treatment object 20 when the ink B is used, among the pH values recorded at Step S103 (Step S104). When there is a pH value lower than the pH reaction value in the case of the ink B (YES at Step S104), the control unit 160 identifies the number of electrodes used corresponding to the pH value lower than the pH reaction value in the case of the ink B, records a least number of electrodes used, among the identified number, associated with information for specifying the ink B as the ink to be used and the type of the fed treatment object for test in the predetermined memory (not illustrated), and ends the present operation.

Meanwhile, when there is no pH value lower than the pH reaction value in the case of the ink B (NO at Step S104), similarly to Step S107 in FIG. 13, the control unit 160 further determines whether there is a pH value lower than the pH reaction value required for the surface of the treatment object 20 when the ink A is used (Step S107). When there is a pH value lower than the pH reaction value in the case of the ink A (YES at Step S107), then the control unit 160 identifies the number of electrodes used corresponding to the pH value lower than the pH reaction value in the case of the ink A, records a least number of electrodes used, among the identified number, associated with information for specifying the ink A as the ink to be used and the type of the fed treatment object for test in the predetermined memory (not illustrated) (Step S202), and ends the present operation. However, when there is no pH value lower than the pH reaction value in the both cases of the ink A and the ink B (NO at Step S104, NO at Step S107), the control unit 160 notifies the user of an error (Step S116), and ends the present operation.

As illustrated in FIG. 16, in the operation for the inkjet recording processing by switching between the inks to be used according to the pH value for each number of electrodes used, a treatment object detecting unit (not illustrated) included in the printing apparatus (system) 1 identifies the type of the treatment object 20 set (type of paper) (Step S210). The treatment object detecting unit is, for example, a mechanism that identifies the type of paper in such a manner that the surface of the treatment object 20 is irradiated with a laser beam and the interference spectra of the resultant reflected light are analyzed, or in a such a manner that a barcode attached to a package of the treatment object 20 is read by a reader. Next, the control unit 160 reads the information for the ink to be used and the number of electrodes used from the predetermined memory used at Step S201 or S202 in FIG. 15, based on the identified type of the treatment object 20 (Step S211), and identifies the ink to be used and the number of electrodes used. The identification of the type of the treatment object 20, information of the ink to be used, and the number of electrodes used is not limited to the above manner, and may be achieved by using all tables read from the predetermined memory used at Step S201 or Step S202 in FIG. 15.

Subsequently, the control unit 160 determines whether the ink to be used is the ink B (Step S212). When the ink to be used is the ink B (YES at Step S212), similarly to Step S106 in FIG. 13, the control unit 160 switches the switching unit 174 illustrated in FIG. 4 to the ink tank 173 for the ink B. Meanwhile, when the ink to be used is not the ink B (NO at Step S212), then the control unit 160 determines whether the ink to be used is the ink A (Step S213). When the ink to be used is the ink A (YES at Step S213), similarly to Step S109 in FIG. 13, the control unit 160 switches the switching unit 174 illustrated in FIG. 4 to the ink tank 172 for the ink A. However, when the ink to be used is neither the ink A nor the ink B (NO at Step S212, NO at Step S213), the control unit 160 notifies the user of an error or of switching to the ink tank 172 or to the ink tank 173 (Step S215), and ends the present operation.

As explained above, after the switching unit 174 is switched to the ink tank 172 or 173, the control unit 160 drives the plasma treatment device 100 using the number of electrodes used identified at Step S211 to start discharging (Step S214). Thereafter, the control unit 160 executes the same operations as these at Steps S110 to S115 in FIG. 13, and repeatedly performs the operations from the feeding of the treatment object 20 to discharging of the treatment object on which the image is formed until the printing of all the print data is completed.

When the pH value of the treatment object 20 after the plasma treatment is previously known, the pH detecting unit 180 may be omitted. The inks to be used may be manually switched to one another for use, other than the method of automatically switching between the inks to be used and using the ink. In this case, the determination, or the like, on the inks to be used can be performed by manual setting or the like performed on the control unit 160. The manual switching between the inks to be used may be a replacement for each inkjet head including an ink tank as explained above.

Figure 17:
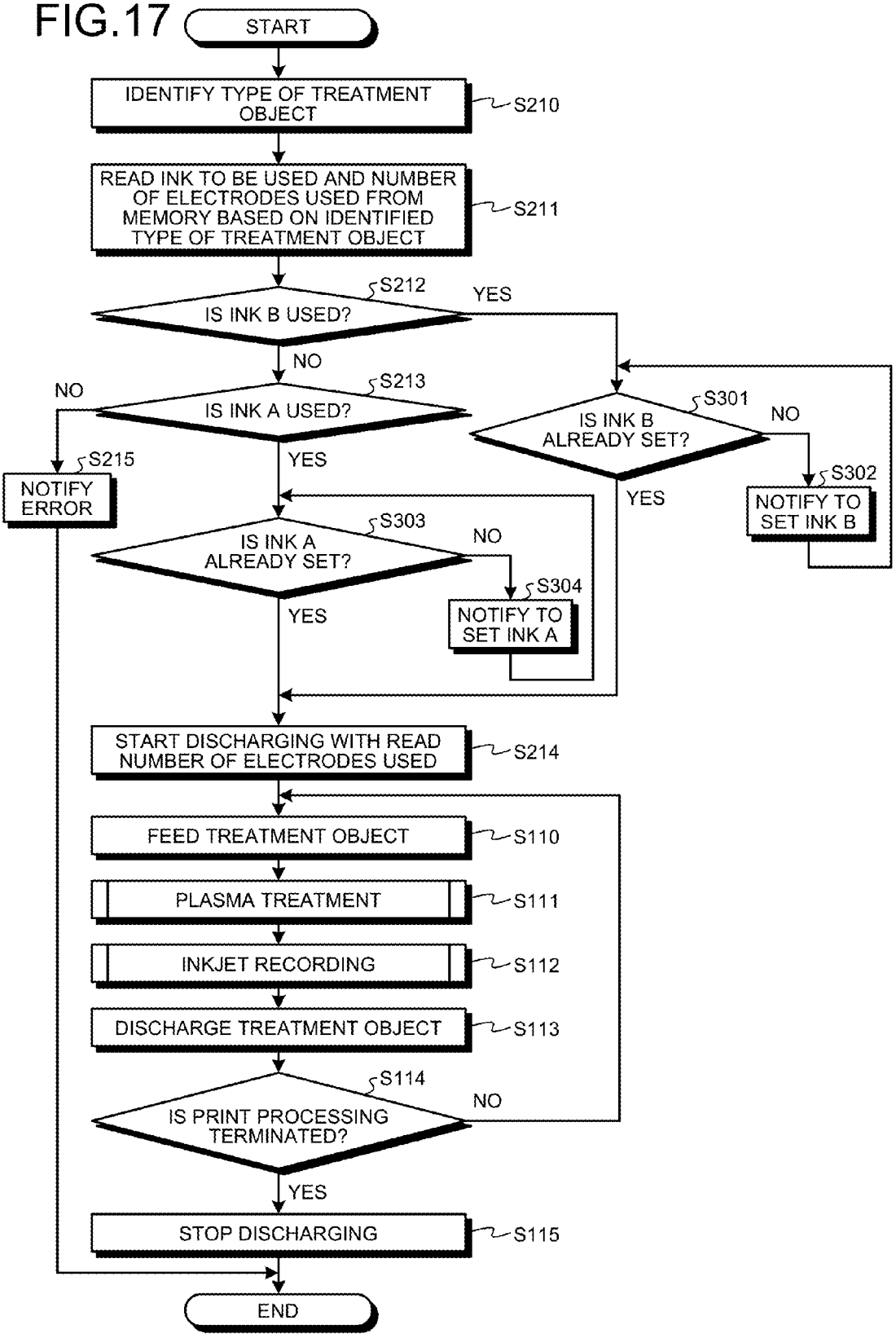
FIG. 17 is a flowchart of an example of operations for performing inkjet recording processing when an ink to be used in FIG. 16 is manually switched.

FIG. 17 is a flowchart of an example of operations for performing inkjet recording processing when an ink to be used in FIG. 16 is manually switched. As illustrated in FIG. 17, the same signs are assigned to operations the same as these of FIG. 16, and overlapping explanation thereof is therefore omitted.

In the operations illustrated in FIG. 17, when it is determined that the ink to be used is the ink B at Step S212 (YES at Step S212), the control unit 160 determines whether the ink B is already set (Step S301). When the ink B is already set (YES at Step S301), the control unit 160 proceeds to Step S214, and performs the subsequent operations. Meanwhile, when the ink B is not set (NO at Step S301), the control unit 160 notifies the user to set the ink B (Step S302), thereafter, returns to Step S301, and waits until the ink B is set.

When it is determined that the ink to be used is the ink A at Step S213 (YES at Step S213), the control unit 160 determines whether the ink A is already set (Step S303). When the ink A is already set (YES at Step S303), the control unit 160 proceeds to Step S214, and performs the subsequent operations. Meanwhile, when the ink A is not set (NO at Step S303), the control unit 160 notifies the user to set the ink A (Step S304), thereafter, returns to Step S303, and waits until the ink A is set.

Figure 18:
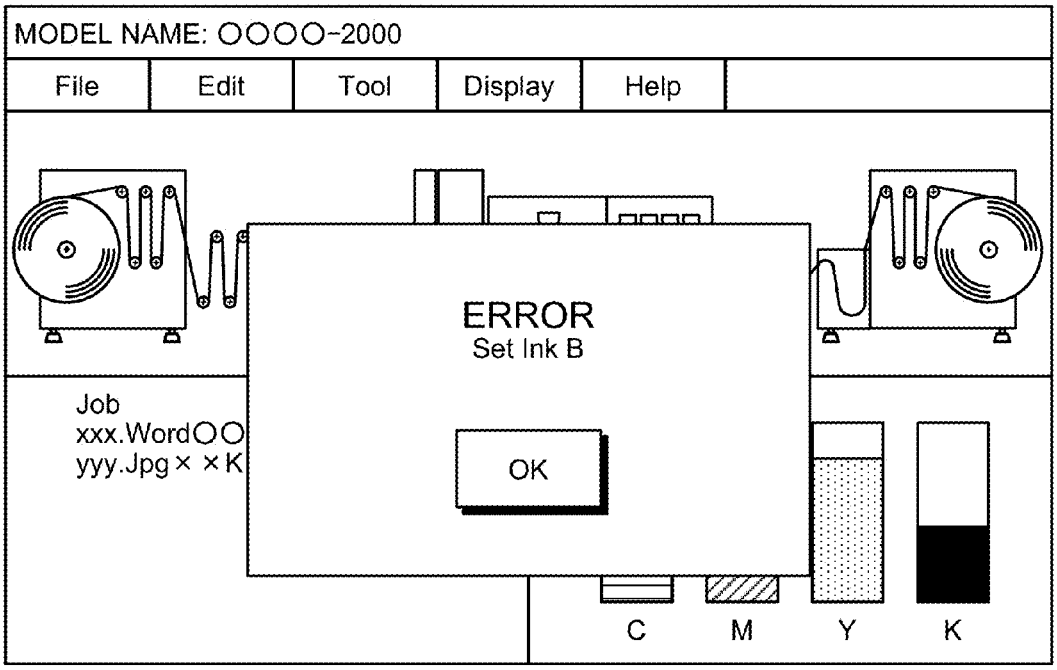
FIG. 18 is a diagram of a screen example used for a notification in FIG. 17.

As a method of notifying the user that the ink A or the ink B is set, it is possible to use, for example, the screen as illustrated in FIG. 18. The screen may be displayed on an operation screen of, for example, a digital front end (DFE) or on a display of the printing apparatus (system) 1. Notification by voice or notification by light using LED or so can be used in addition to the notification by screen.

Figure 19:
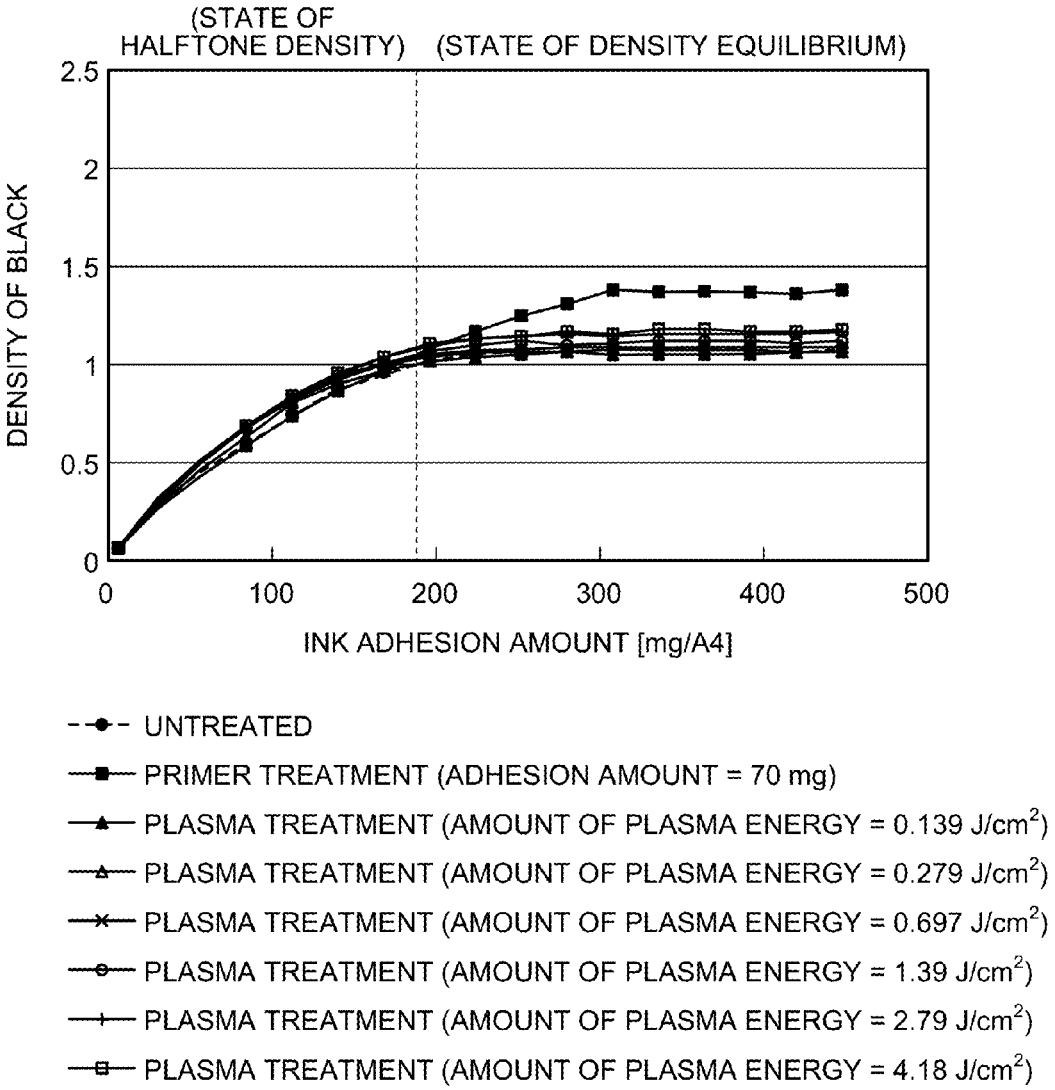
FIG. 19 is a graph representing measurement results of an image (dot) density of a treatment object subjected to primer treatment and of a treatment object subjected to plasma treatment with respect to an ink adhesion amount.

FIG. 19 represents measurement results of an image (dot) density of the treatment object subjected to the primer treatment and of the treatment object subjected to the plasma treatment with respect to an ink adhesion amount. A plain paper is used as the treatment object 20 and a black ink is used as the ink in FIG. 19. As illustrated in FIG. 19, when the plain paper is used as the treatment object 20, the dot density of the plain paper subjected to the plasma treatment is totally higher than that of the plain paper not subjected to any pretreatment (hereinafter, "untreated plain paper"); however, the saturation concentration of the plain paper is low as compared with the plain paper subjected to the primer treatment.

The dot density (halftone density) before it reaches a density equilibrium state more effectively increases in the plasma treatment than in the primer treatment. This indicates that when halftone dots are formed, the ink adhesion amount to obtain the same dot density that is required for the plain paper subjected to the plasma treatment is less than for the plain paper subjected to the primer treatment. Specifically, the ink adhesion amount required for the plain paper subjected to the plasma treatment can be reduced by 1% to 18% as compared with that for the untreated plain paper, and can be reduced by 15% to 29% as compared with that for the plain paper subjected to the primer treatment.

The reason that the saturation concentration in the plain paper subjected to the plasma treatment becomes lower than the saturation concentration in the plain paper subjected to the primer treatment is because the dot density in the plain paper subjected to the primer treatment is increased due to the effect of setting. In other words, because dots landed on the plain paper subjected to the primer treatment spread, the pigments are dispersed by an amount of the spread and a peak density drops even if the adhesion amount is the same. However, because the dots hardly spread on the plain paper subjected to the primer treatment, the saturation concentration increases accordingly.

From the results obtained in the above manner, different effects can be obtained between the plasma treatment and the primer treatment performed on the treatment object which is hardly permeable and on the treatment object which is easily permeable. It is found from the obtained effects that a combination of the plasma treatment and the primer treatment as the printing system allows improvement of a response capability of the treatment object 20 to image formation. The combination of the plasma treatment and the primer treatment also allows reduction of the amount of plasma energy to, for example, about 1/20 of the plasma treatment as a single treatment, and reduction of the coating amount to about 3/5 of the primer treatment as a single treatment. This means that a printed material with high image quality can be obtained with a low energy consumption and a low coating amount. Furthermore, the high dot density can be obtained, which enables reduction of the amount of ink to adhere. Thus, printing costs can further be reduced.

Moreover, it is found from the results in FIG. 19 that the plasma treatment effectively acts on the treatment object which is hardly permeable and that the primer treatment effectively acts on the treatment object which is easily permeable. This indicates that an optimal pretreatment performed on a treatment object can be achieved by appropriately adjusting implementation conditions of the plasma treatment and the primer treatment according to the property of the treatment object.

Figure 20:
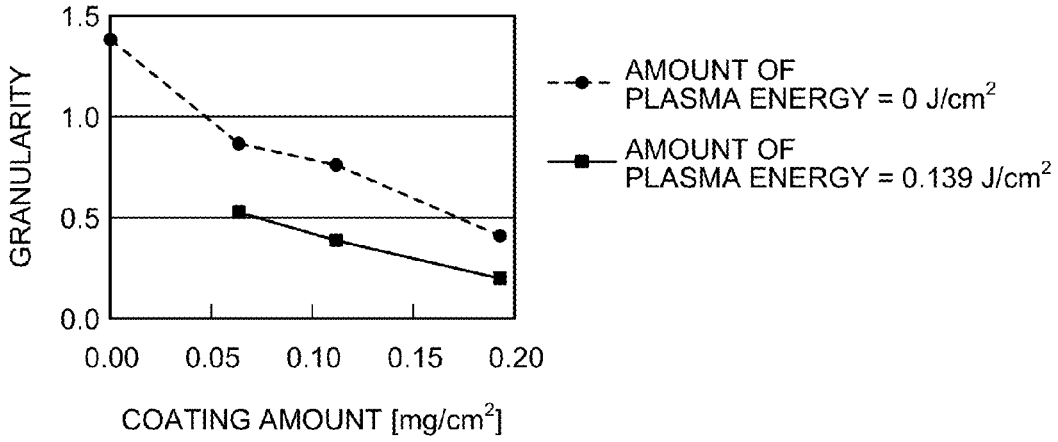
FIG. 20 is a graph representing granularity of a treatment object which is hardly permeable when the plasma treatment and the primer treatment are combined.

FIG. 20 is a graph representing granularity of a treatment object which is hardly permeable when the plasma treatment and the primer treatment are combined. The graph illustrated in FIG. 20 represents that a more satisfactory image is obtained as the granularity is lower. In FIG. 20, the broken line indicates a result of the treatment liquid in the primer treatment with respect to the coating amount when the amount of plasma energy is set to 0 $J/cm^2$ (i.e. when the plasma treatment is not performed). The solid line indicates a result of the treatment liquid in the primer treatment with respect to the coating amount when the amount of plasma energy is set to 0.14 $J/cm^2$ (i.e. when the plasma treatment and the primer treatment are combined). As illustrated in FIG. 20, to achieve a granularity of, for example, 0.5 or lower, a coating amount of about 0.2 $mg/cm^2$ is needed when only the primer treatment is performed, while only a coating amount of about 0.1 $mg/cm^2$, which is a half of the coating amount, is needed when the primer treatment and the plasma treatment are combined.

The optimization control derived from FIG. 20 is for the treatment object. Considering optimization of an image, it is more preferable to perform optimization control based on the printed material obtained through actual printing. For example, a reflection densitometer is incorporated in the printing apparatus (system) 1, energy for the plasma treatment or a coating amount for the primer treatment performed on the treatment object is continuously changed, a printing pattern which is a reference is printed by the inkjet recording device 170, and a printing density of the obtained printed material is measured by the reflection densitometer. A treatment condition with which the highest printing density is obtained is determined as an optimal condition, and inkjet recording is performed while executing the optimization control so as to maintain the optimal condition. Accordingly, the measurement and the treatment condition can be changed in a short period of time, thus improving a throughput of the print processing. In addition, the optimal condition identified based on density information acquired from the reflection densitometer can be stored as database.

When the component or the type of ink or the type of a treatment object is changed, the optimal condition may also be changed. In this case, by storing and managing the optimal condition in association with the component and the type of ink and the type of the treatment object, the optimization control can be achieved according to various conditions.

Moreover, for example, an electrical resistance of a treatment object is measured before the plasma treatment is performed, and the thickness and properties of the treatment object are identified to some extent, so that the study is conducted to derive an optimal condition.

Furthermore, when the treatment object is a cut sheet, it may be configured to provide a sensor in the discharging unit of the plasma treatment device 100 and in a discharging unit of a primer treatment device, to obtain a state of the respective treatments, and to perform re-treatment via a different conveying path as needed. In this case, the control unit 160 may perform feedback control or feedforward control on the respective treatment conditions of the plasma treatment device 100 and of the primer treatment device based on the information from the sensors.

As explained above, the combined treatment of the plasma treatment and the primer treatment allows downsizing of the printing apparatus (system) 1 while reducing the energy required for the plasma treatment, and allows reduction of a treatment liquid, a drying time of vehicles, and of a drying energy while reducing a coating amount required for the primer treatment. The combined treatment also allows reduction of an ink use amount. Furthermore, when the combined treatment of the plasma treatment and the primer treatment is executed to perform inkjet recording, dots can be formed close to an exact circle and pigments can be prevented from being mixed even if the dots coalesce, thus obtaining a satisfactory image with less blurring.

According to the embodiment, it is possible to achieve the printing apparatus, the printing system, and the printed material manufacturing method capable of providing stable quality of image.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A printing apparatus comprising:

a plasma treatment unit that acidifies at least a surface of a treatment object by irradiating the treatment object with plasma;

an inkjet recording unit that records to the treatment object having been irradiated with plasma by the plasma treatment unit in an inkjet recording system; and a control unit that specifies an ink to be used by the inkjet recording unit from at least two types of inks having different properties, based on the type of the treatment object and an amount of plasma energy used by the plasma treatment unit or based on a pH value of the surface of the treatment object.

2. The printing apparatus according to claim 1, wherein the control unit specifies the ink to be used by the inkjet recording unit from the at least two types of inks, based on the pH value of the surface of the treatment object.

3. The printing apparatus according to claim 2, further comprising:

a pH detecting unit that detects the pH value of the surface of the treatment object having been irradiated with plasma by the plasma treatment unit, wherein the control unit specifies the ink to be used by the inkjet recording unit from the at least the two types of inks, based on the pH value detected by the pH detecting unit.

4. The printing apparatus according to claim 1, further comprising:

reservoir units that reserve at least the two types of inks, respectively; and a switching unit that switches an ink to be supplied to the inkjet recording unit from the reservoir units to either one of at least the two types of inks, wherein the control unit controls the switching unit so that the ink specified as being used by the inkjet recording unit is supplied from the reservoir unit to the inkjet recording unit.

5. The printing apparatus according to claim 1, further comprising:

a notification unit that notifies a user to set the ink specified as being used by the inkjet recording unit, wherein the control unit notifies the user to set the ink specified as being used by the inkjet recording unit via the notification unit when the ink specified as being used by the inkjet recording unit is not set.

6. The printing apparatus according to claim 1, wherein a first pH value needed so that a first ink of at least the two types of inks has a predetermined viscosity or higher is lower than a second pH value needed so that a second ink of at least the two types of inks has the predetermined viscosity or higher, the plasma treatment unit irradiates the surface of the treatment object so that each area on the surface of the treatment object is subjected to acidification at a different level, the control unit specifies the ink to be used by the inkjet recording unit as the first ink when there is an area in which a pH value is the first pH value or lower, of a plurality of areas each on which the acidification of the different level is performed, and the control unit specifies the ink to be used by the inkjet recording unit as the second ink when there is no area in which the pH value is the first pH value or lower but there is an area in which the pH value is the second pH value or lower.

7. The printing apparatus according to claim 1, wherein the control unit controls the plasma treatment unit so as to further perform acidification having been subjected to an area in which the pH value is highest of the areas in which the pH value is a first pH value or lower when there is one or more of the areas, of the areas, in which the pH value is the first pH value or lower, and the control unit controls the plasma treatment unit so as to further perform acidification having been subjected to an area in which the pH value is highest of the areas in which the pH value is a second pH value or lower when there is no area in which the pH value is the first pH value or lower but there is one or more of the areas in which the pH value is the second pH value or lower.

8. A printing system comprising:

a plasma treatment device that acidifies at least a surface of a treatment object by irradiating the treatment object with plasma; and an inkjet recording device that records to the treatment object having been irradiated with plasma by the plasma treatment device in an inkjet recording system, wherein the inkjet recording device includes a control unit that specifies an ink to be used by the inkjet recording unit from at least two types of inks having different properties, based on the type of the treatment object and an amount of plasma energy used by the plasma treatment device or based on a pH value of the surface of the treatment object.

9. A printed material manufacturing method for manufacturing a printed material obtained by forming an image on a treatment object in an inkjet recording system, the method comprising:

acidifying at least a surface of the treatment object by irradiating the treatment object with plasma;

specifying an ink to be used in the forming of the image from at least two types of inks having different properties, based on the type of the treatment object and an amount of plasma energy used by a plasma treatment unit at the acidifying or based on a pH value of the surface of the treatment object; and recording to the treatment having been acidified by the plasma treatment unit with the ink specified.

* * * * *